United States Patent [19]

Morris et al.

[11] Patent Number: 4,581,114

[45] Date of Patent: Apr. 8, 1986

[54] METHOD OF MAKING A UNITARY CENTRAL CELL STRUCTURAL ELEMENT FOR BOTH MONOPOLAR AND BIPOLAR FILTER PRESS TYPE ELECTROLYSIS CELL STRUCTURAL UNITS

[75] Inventors: Gregory J. E. Morris, Lake Jackson; Richard N. Beaver, Angleton; Sandor Grosshandler, Houston; John R. Pimlott, Sweeny; Hiep D. Dang, Lake Jackson, all of Tex.

[73] Assignee: The Dow Chemical Company, Midland, Mich.

[21] Appl. No.: 758,173

[22] Filed: Jul. 23, 1985

Related U.S. Application Data

[63] Continuation of Ser. No. 683,128, Dec. 17, 1984, abandoned, which is a continuation-in-part of Ser. No. 472,792, Mar. 7, 1983, Pat. No. 4,488,946.

[51] Int. Cl.[4] ..... C25B 9/04

[52] U.S. Cl. ..... 204/267; 29/825; 204/253; 204/254; 204/268; 204/279

[58] Field of Search ..... 29/825; 164/DIG. 1, 164/47; 204/98, 128, 254–256, 268, 279, 286, 297 R, 267

[56] References Cited

U.S. PATENT DOCUMENTS

| | | | |
|---|---|---|---|
| 3,451,853 | 6/1969 | Spahrbier | 164/DIG. 1 |
| 3,752,757 | 8/1973 | Stephenson, III et al. | 204/256 |
| 3,788,966 | 1/1974 | Stephenson, III et al. | 204/256 |
| 3,859,197 | 1/1975 | Bouy et al. | 204/284 |
| 3,948,750 | 4/1976 | Figueras et al. | 204/286 |
| 3,960,698 | 6/1976 | Bortak | 204/267 |
| 4,017,375 | 4/1977 | Pohto | 204/255 |
| 4,040,934 | 8/1977 | Hoekje et al. | 204/256 |
| 4,056,458 | 11/1977 | Pohto et al. | 204/263 |
| 4,086,695 | 5/1978 | Cornette | 164/DIG. 1 |
| 4,111,779 | 9/1978 | Seko et al. | 204/255 |
| 4,116,805 | 9/1978 | Ichisaka et al. | 204/290 F |
| 4,116,807 | 9/1978 | Peters | 204/290 F |
| 4,137,145 | 1/1979 | Wallace | 204/290 R |
| 4,194,670 | 3/1980 | Ichisaka et al. | 228/179 |
| 4,214,969 | 7/1980 | Lawrance | 204/255 |
| 4,247,376 | 1/1981 | Dempsey et al. | 204/128 |
| 4,279,731 | 7/1981 | Pellegri | 204/254 |
| 4,294,671 | 10/1981 | Balko | 204/128 |
| 4,312,737 | 1/1982 | Kircher | 204/257 |
| 4,339,322 | 7/1982 | Balko et al. | 204/255 |
| 4,464,242 | 8/1984 | Boulton | 204/253 |

FOREIGN PATENT DOCUMENTS

| | | | |
|---|---|---|---|
| 0080288 | 6/1983 | European Pat. Off. | 204/266 |

*Primary Examiner*—Andrew H. Metz
*Assistant Examiner*—Terryence Chapman
*Attorney, Agent, or Firm*—Melvin William Barrow

[57] ABSTRACT

A generic, simple, economical method for making and assembling either a monopolar or bipolar filter press type electrochemical cell unit. The first feature is making a novel central cell element. This cell element is an integrally formed, unitary, cast structural element for filter press electrolysis cell which incorporates into a single cell unit the central barrier between the peripheral boundaries for the adjacent anolyte compartment and adjacent catholyte compartment of two electrolysis cells located on opposite sides of the central barrier. Also incorporated into the single cast structural element are anode bosses and cathode bosses extending outwardly from opposite sides of the central barrier. These bosses not only serve as mechanical support for their respective flat plate anode and cathode elements, but also they serve as stand-off means and electrical current collectors and dispersers from the cathode of one electrolysis cell to the anode of the next cell. Simplicity of design coupled with incorporation of many functional elements into one part eliminates many cell warpage problems, inherent high voltage problems and membrane "hot spot" problems. The second step in the method is the attachment of protective metal liner pans to the sides of the central cell element.

37 Claims, 11 Drawing Figures

BIPOLAR CELL ASSEMBLY

BIPOLAR CELL UNIT

CATHODE SIDE OF BIPOLAR UNIT

ANODE SIDE OF BIPOLAR UNIT

MONOPOLAR CELL ASSEMBLY

MONOPOLAR ANODE CELL UNIT

MONOPOLAR CATHODE CELL UNIT

MONOPOLAR ANODE CELL UNIT

MONOPOLAR CATHODE CELL UNIT

METHOD OF MAKING A UNITARY CENTRAL CELL STRUCTURAL ELEMENT FOR BOTH MONOPOLAR AND BIPOLAR FILTER PRESS TYPE ELECTROLYSIS CELL STRUCTURAL UNITS

CROSS-REFERENCE TO RELATED APPLICATION

This is a continuation of App. Ser. No. 683,128 filed 12-17-84, which is now abandoned, and which is itself a continuation-in-part of App. Ser. No. 472,792, filed 3-7-83, now U.S. Pat. No. 4,488,946.

The invention relates to a method of making a cell structural unit for one of the repeating units of a bipolar electrode type series of electrolysis cells arranged in a configuration which is commonly referred to as a filter press type cell series, and, surprisingly, this invention also relates to a method of making virtually the same cell structural unit for one of the repeating units of a monopolar electrode type of electrolysis cell structural units also arranged in a configuration referred to as a filter press type cell series. Monopolar electrode type electrolysis cells arranged in a filter press configuration are well known to those skilled in the art. What is not well known is the ability of using the same type cell structural element in either the bipolar electrode type of filter press cell configuration or the monopolar electrode type of filter press cell configurations. This results from the different electrical distribution properties inherently required for a monopolar electrode and a bipolar electrode. These differences will be better understood by the way this invention is described herein. The specification for this patent application for this invention is divided into four main sections below, aside from the claims. These four sections are: "Background of the Invention", "Statement of the Invention", "Brief Discussion of the Drawing", and "Detailed Description of the Preferred Embodiment of the Invention". To help understand the uniqueness of using the same method of making a central cell structure which is useful in both a bipolar electrode electrolytic cell series filter press configuration and a monopolar electrode electrolytic cell series filter press configuration, these four sections will be divided into two subsections each; i.e., a "Bipolar Electrode Type" subsection and a "Monopolar Electrode Type" subsection.

It will be noted that although the invention as claimed relates to a method of making a cell structure, most of the specification and drawings are directed toward a description of the structure itself. This is done in order to better appreciate the inventive method of making this structure. It will be recognized by those skilled in the art that in the discussions in the "Bipolar Electrode Type" and "Monopolar Electrode Type" subsections of this specification, several aspects of the bipolar and monopolar types are the same. Hence, the monopolar discussion will be devoted primarily to how the monopolar aspect of the invention differs from the bipolar aspect.

BACKGROUND OF THE INVENTION

A. Bipolar Electrode Type

This invention relates to an improvement in the structure of bipolar electrode type, filter press type electrolysis cells. More particularly it relates to those of such cells which employ permselective ion exchange membranes planarly disposed between flat surfaced, parallel, foraminous, metal anodes and cathodes when said anodes and cathodes are mounted at a distance from the fluid impermeable structure of the bipolar electrode which physically separates adjacent electrolysis cells. Such cells are particularly useful in the electrolysis of aqueous solutions of alkali metal chlorides; especially in the electrolysis of aqueous solutions of sodium chloride (sodium chloride brine). The cell structure may also be used in electrolyzing other solutions to make products such as potassium hydroxide, iodine, bromine, bromic acid, persulfuric acid, chloric acid, adiponitrile and other organic compounds made by electrolysis.

The unitary filter press central cell element of the present invention decreases the cost of manufacture of the cell units, decreases the labor required to assemble them, simplifies their manufacture, greatly reduces the warpage of the cell unit parts, and provides a much sturdier cell structure than do bipolar, filter press cells of the prior art.

Reducing the warpage cell structure allows the cell to be operated more efficiently; i.e., produce more units of electrolysis products per unit of electricity. Reducing the warpage reduces the deviation from design of the gap width between the anode and cathode of each electrolysis cell. Ideally this gap width is uniformly the same between the anode and cathode in order to have a uniform current density spread between the faces of the cell electrodes. Among other things, structural warpage causes deviation of this gap resulting in some parts of the anode and cathode being closer together than others. At these locations, the electrical resistance is less, the electrical current is more, and thus the electrical heating is greater. This electrical heating is sufficient in many instances to cause damage to the membrane at these locations. These locations of unacceptably high electrical current concentration and high heat are referred to herein as "hot spots".

To avoid these hot spots, the prior art has had to design its cell structures with a greater than desired gap width between the anode and cathode of each electrolysis cell. This, of course, increases the cell operating voltage and decreases the cell operating efficiency. Complexity of design and fabrication is another drawback of those cells.

Except for the structures used for the terminal cells of a bipolar filter press cell series, the structures for the intermediate cells in the series are like, repetitious, cell structural units which are squeezed together. Examples of such cells operated in a cell series are disclosed in Seko, U.S. Pat. No. 4,111,779 (Sept. 5, 1978) and in Pohto, U.S. Pat. No. 4,017,375 (Apr. 12, 1977). These patents are herein incorporated by reference for purposes of showing representative prior art and for showing how bipolar filter press cells are formed into and operated in a cell series.

At this point, a clarification should be made about confusing nomenclature sometimes encountered when speaking of a series of bipolar filter press cells. The problem involves the nomenclature often encountered when dealing with the repeating electrolysis cells themselves and the repeating cell structure units used to house these repeating electrolysis cells. In the electrolysis cells there is often a membrane which is generally planarly disposed in or about the center of each electrolysis cell between a parallel anode and cathode. The membrane divides the electrolysis cell itself into an anolyte and catholyte compartment. However, in appearance in a cell series the membrane often appears to be the division line between repeating cell structural units. In fact, the membrane often is located at the division between repeating cell structures in the series, but not at the division line separating different electrolysis cells. This comes about because the repeating cell structures are situated between and around parts of adjacent, but different, electrolysis cells. A repeating bipolar cell structure such as this includes structure which defines the periphery of the catholyte compartment of one of two adjacent electrolysis cells. This repeating cell unit structure for bipolar cells also includes structure which defines the periphery of the anolyte compartment of the other of the two adjacent electrolysis cells and the barrier structure separating the two electrolysis cells. So the anolyte compartment and the catholyte compartment associated with a given repeating structural unit are compartments of adjacent, but different, electrolysis cells. This is not the case in monopolar cell units, for therein the repeating cell units have either anolyte compartments or cathode compartments in both sides of the cell unit structure.

These repeating cell structures include several other structural elements which will be discussed below. Herein this repeating structural unit will be referred to as a "bipolar electrode type, filter press type electrolytic cell unit". As used with the present invention, this cell unit is referenced in the drawing by reference number 10.

Other structural elements which are included in a bipolar electrode type, filter press type electrolytic cell unit besides the electrolyte compartments peripheral structure and the electrolyte impervious central barrier are an anode, a cathode, an anode stand-off means, a cathode stand-off means, and an electrical current transfer means. The permselective ion-exchange membranes are usually not considered as part of this structural unit although they are present.

The central barrier is between and may separate the anolyte compartment of one adjacent electrolysis cell from the catholyte compartment of the other adjacent electrolysis cell.

The anode and cathode are spaced from and spaced on opposite sides of the central barrier by the anode and cathode stand-off means, respectively. This spacing is provided so as to provide room for the electrolyte and electrolysis products to circulate in the space between the electrodes and their central barriers.

The anode stand-off means and cathode stand-off means most often also serve as the electrical current means used to electrically connect the anode on one side of the barrier with the cathode on the opposite side of the barrier. This connection is made through the barrier.

The anode and cathode are usually of the "flat plate" type. That is, they present a planarly disposed working surface, or assembly of surfaces, to their respective membranes. They are most often parallelly disposed to their respective membranes, to the axis plane of the central barrier, and to each other. Also the anode and cathode are usually made of a foraminous metal.

The anolyte compartment is defined by the space between the central barrier and the membrane disposed on the anode side of the central barrier as well as the structure fitted around and between the periphery of this membrane and central barrier. Note, the anode is disposed within the anolyte compartment by definition. Likewise the catholyte compartment is defined as the space between the central barrier and the membrane on the cathode side of the central barrier and by the peripheral structure fitted around and between the periphery of the central barrier and the membrane on the cathode side of the central barrier. The cathode is disposed in the catholyte compartment by definition.

The anode and cathode of a repeating unit structure (along with the central barrier and the electrical connecting means which electrically connects the anode to the cathode through the central barrier) are, of course, often referred to as a "bipolar electrode". This is because, in effect, this connection of structure series is as an anode in one electrolysis cell and a cathode in another electrolysis cell.

The above features of a flat plate bipolar electrode type, filter press type electrolytic cell unit can also be observed in the following references U.S. Pat. Nos.: 4,364,815; 4,111,779; 4,115,236; 4,017,375; 3,960,698; 3,859,197; 3,752,757; 4,194,670; 3,788,966; 3,884,781; 4,137,144; and 3,960,699.

A review of these patents discloses the above described structural elements in various forms, shapes and connecting means.

What is surprising to one not skilled in this art is the complexity of connections of these parts as well as the large number of parts required for what seems to be a relatively simple structural assembly problem. Of course, to those skilled in the art this complexity is well understood as the outgrowth of trying to make profitable, commercial cell structures for use with the relatively new permselective ion-exchange membranes and the extremes of corrosive conditions extant between the anolyte and catholyte compartments. These membranes operate best at elevated temperatures and high caustic concentrations, e.g., above about 80° C. at about 20–45% caustic catholyte concentrations. This compounds the problems of constructing profitable cells.

The problem centers around finding an affordable anode material and other materials which can withstand the extremely corrosive conditions of the anolyte chamber. For profitable, commercial operations, titanium is the material which has been found which has the most promise for profitable use.

However, there is a great disadvantage in the use of titanium with other metals suitable for use in the anolyte chamber. This is titanium's inability to form a good weld with ferrous materials and most other materials. This is most unfortunate because steel and other ferrous metal alloys have been used quite successfully for many years as the cathode material.

The major reason for the complexity existing in the connections as well as the reason for having so many connections and so many separate parts in each filter press cell unit of the prior art stems from the necessity of using titanium coupled with the relatively high cost of titanium with respect to the cost of steel or iron coupled with the necessity of establishing a very low electrical resistance connection between the anode and the cathode. The present invention greatly reduces the number of connections, number of separate parts, and the problems they cause. Further discussion of these problems will be better appreciated by perusing the prior art.

As stated above, one of the main problems is that titanium cannot be successfully welded directly to ferrous materials. See Seko, U.S. Pat. No. 4,111,779 at Column 1. Also see Mitchell, D. R.; Kessler, H. D.; "The Welding of Titanium to Steel", *Welding Journal*

(Dec. 1961). In the Seko patent, titanium is joined to steel by explosion bonding steel plate to titanium plate. In the Mitchell et al *Welding Journal* article, titanium is indirectly welded to steel by welding through a vanadium intermediate placed between the steel and titanium.

The prior art discloses complex and elaborate schemes devised to electrically and/or mechanically connect the different parts of the cell wherein titanium and titanium alloys are employed. Particularly is this complexity seen to be true with respect to the parts herein referred to as stand-offs which connect the "flat plate" anode and cathode of a bipolar electrode structure to an electrically conductive central barrier at a spaced distance from the central barrier; e.g. Seko U.S. Pat. No. 4,111,779 and Ichisaka et al, U.S. Pat. No. 4,194,670. Other stand-offs are used to support the flat plate electrodes and to electrically and mechanically connect them through holes in a non-conductive central barrier, e.g., Stephenson III, et al, U.S. Pat. No. 3,752,757 and Bortak, U.S. Pat. No. 3,960,698. It will be noticed that in these connections, welds and/or bolts are used to connect the stand-offs to the electrodes and then again to the central barrier or to opposing stand-offs passing through the central barrier. Many problems are associated with these many connections. These problems would not be so formidable if only a few connections were required for each of the many cells in a series, but many are required for each cell to get adequate electrical current distribution.

The present invention reduces these problems by eliminating many of these connections. It does this by integrally casting these stand-offs with the central barrier. Moreover, the connections used to connect the central barrier to the peripheral structure of the anolyte and catholyte compartment are also eliminated by integrally casting these structures with the central barrier.

Other problems associated with having so many such connections include unequal electrical current transfer, warpage of parts, and creation of more stress points in the titanium. Such stress points are subject to attack by atomic hydrogen as well as increased susceptibility to normal chemical corrosion and galvanic corrosion.

The electrical transfer capability of a bolted connection is dependent upon the sufficiency of the friction contact between the threads of the two mating threaded pieces. Many bolts are used in making the connections for each bipolar unit when they are depended upon to connect the electrodes and/or stand-offs. They are depended upon to carry equal amounts of current to avoid "hot spots" on the electrodes and adjacent membranes. However, this would require perfect equality of mating of all threaded surfaces. Perfection can not be closely approximated in these cells without going to extraordinary costs. Hence, "hot spots" do occur, and if they do not burn the membrane, they at least cause distorted electrolysis reaction rates across the face of the electrode.

As to welded connections, electrical transmission through them is dependent upon the percentage of the cross-sectional area of the supposed weld which is actually welded. Maldistribution of the amount of welded surface area from weld to weld across the face of a bipolar electrode is very difficult to avoid. Thus with maldistribution of welds, there occurs maldistribution of electric current which, like the threaded bolt problem, causes the undesired electrical "hot spots" on the membrane and "flat plate" electrodes.

Warpage is another undesired side effect of welding. Welding invariably causes warpage in the workpiece. Warpage problems may initially begin before fabrication. When working with large weldments, the individual parts themselves may not be straight, flat, smooth, etc., which will ultimately cause problems during and after fabrication. For proper alignment and positioning of parts, jigs and fixtures often are not adequate to compensate for such problems.

When working with large flat structures (such as cell bodies) the biggest concern lies with warpage that occurs due to the welding itself. Methods to correct such warpage may include heating/cooling, pressing, heating/pressing, and machining. All such methods of relieving warpage induced by welding, however, may in turn induce additional stresses in the structure and thereby cause secondary warpage in the part. These methods also increase the cost of the cell bodies.

In addition to warpage, other concerns which are common to welded structures include: (1) undesirable weld stresses within the part, (2) defective welds, (3) correcting welds which are defective, (4) examination of the weldment for flaws.

In both the all welded cell structures and the welded and bolted metal cell structures, it is difficult to maintain uniform planes between the anolyte and catholyte compartments. Consequently these non-uniform planes cause a non-uniform electrical current distribution across the active surface of the catholyte and anolyte chambers. Since the distribution of electric current is non-uniform, the electrical reactions are also non-uniform. It occurs vigorously at localized areas and thereby causes localized heating effects there, that is "hot spots".

Another problem associated with these non-uniform planes is that the anode and the cathode cannot be brought sufficiently close to each other without the fear of puncturing the membrane. Thus a large voltage loss is incurred because these electrodes can not be spaced as close to each other as desired.

All of the above leads to a shortening of the life of the electrolytic cell.

The present invention by comparison has eliminated most of the problems listed above which are common to the weldment type structure and the welded and bolted structure. As a result, cell electrodes are more uniformly parallel; there is a more uniform distribution of electrical current and electrolytic reaction in the cell during operation; and the invention also provides a leakproof centerboard or central barrier.

Another undesired effect of threads and welds in titanium is that they create stress points in the titanium. These stress points are very susceptible to attack by atomic hydrogen. This attack forms significant concentrations of hydrides of titanium at temperatures greater than 80° C. These hydrides are structurally unsound and resistant to the passage of electricity. Thus the purposes for which these threads or welds were made in the first place are substantially undone when hydrides are formed thereat.

The source of this atomic hydrogen is primarily the catholyte chamber where water is electrolyzed to hydrogen and hydroxide. It would seem that little trouble would be expected in titanium located in the anolyte compartment from atomic hydrogen generated in the catholyte compartment, particularly when there is a steel central barrier located between them.

However, this hydrogen diffuses through the steel and does attack titanium stress points with particular devastating results at temperatures greater than 80° C., the temperature above which membrane cells coincidently seem to operate best.

The atomic hydrogen attacks the titanium stress points directly connected to the steel. This is one of the flaws in the reasoning given for using a steel to titanium explosion bonded central barrier as is disclosed and claimed in Seko, U.S. Pat. No. 4,111,779. The whole bonded area of the titanium is under stress and is therefore subject to the hydride formation discussed above. At first no problem is detected because sufficient hydrogen has not penetrated the steel and reached the titanium. However, as the titanium hydride formation increases in these central barriers at the titanium steel bond, the electrical conductivity and the structural integrity decreases until the central barriers are worthless and even dangerous.

The present invention greatly reduces the risk of titanium hydride formation by creating a structure which has a titanium liner with only a relatively very few stress points in it, and also by locating these stress points at an extreme distance from the hydrogen source with respect to the amount of ferrous metal which must be traversed in order to reach any of these few stress points. The only stress points found in the present invention's titanium hot pressed liner are found at the sites where it is welded to the ends of the anode bosses. These will be discussed below. It should be understood, however, that although the present invention has been discussed principally in terms of the commonly used ferrous metal and titanium, it is not limited to these materials of construction.

B. Monopolar Electrode Type

This invention also relates to filter press electrolysis cell series of the monopolar electrode type. A filter press electrolysis cell series of the monopolar electrode type differs first from a filter press series of the bipolar-electrode type in that each anode and each cathode of the cells in the series are electrically connected, respectively, in parallel and not in an electrical series as are the bipolar electrode type cells disposed in a filter press type of cell series. That is, in a typical monopolar electrode type of cell series, the anode of each electrolysis cell is electrically connected through its cell's peripheral structure to the same positive electrical energy supply source as each of the other anodes of the cells in the series so that each anode is at substantially the same absolute voltage potential. Likewise, the cathode of each monopolar electrolysis cell in a monopolar filter press cell series is connected through its cell's peripheral structure to the same negative electrical energy supply source as each of the other cell cathodes in the series so that each cathode in the monopolar cell series is at substantially the same absolute voltage potential. Thus, although the cells in a monopolar filter press configuration are physically arranged in a face-to-face series configuration, they nevertheless have their like electrodes connected in an electrically parallel configuration. A monopolar cell assembly may be called a stack or a series. Conversely, the electrodes in a bipolar electrode type of filter press series are connected in a series electrical arrangement instead of a parallel electrical arrangement. In a bipolar electrode filter press series the positive electrical energy source is applied only to the anode of one of the two terminal electrolysis cells of the bipolar series and the negative electrical energy source is applied to the cathode of the other terminal cell which is located at the opposite end of the bipolar cell series. A large D.C. voltage difference is applied between these two electrical sources, and electrical current flows from electrolysis cell to electrolysis cell in the bipolar cell series between these two electrical sources throughout the length of the series.

This different electrical connecting arrangement forces the monopolar series to be different in other ways from the bipolar series. For example, a monopolar anode unit located in the interior cell structures of a monopolar filter press series serves as the anodes for its two adjacent electrolysis cells. Likewise, the interior cell monopolar cathode unit likewise acts as the cathodes for the two electrolysis cells which are adjacent to it.

Further descriptions of monopolar electrodes used in a filter press series of electrolytic cells are given in: (A) U.S. Pat. No. 4,056,458 issued to G. R. Pohto et al. on Nov. 1, 1977, and assigned to Diamond Shamrock Corporation; and (B) U.S. Pat. No. 4,315,810 issued to M. S. Kircher on Feb. 16, 1982, and assigned to Olin Corporation. Both of these patents teach the use of one type structure to support the monopolar filter press cell unit and they teach the use of other structures (a plurality of conductor rods or bars) to distribute electricity from an electrical source located outside the cells to the monopolar electrode elements disposed within the cell. Other complexities of monopolar filter press series which call for many parts and many connections are observed from a study of these two patents.

The present invention allows the construction of monopolar cell series which are much more simple, much sturdier, but yet economical to manufacture and operate.

STATEMENT OF THE INVENTION

The present invention relates to the making and assembling the structure of electrolytic cell units used as the repeating units in filter press type cell series. The cell unit is useful for both monopolar and bipolar filter press cell series. It is useful in brine electrolysis and in other electrochemical processes. Making an integrally formed metal central cell element is the fundamental building block of the invention. This method is comprised of:

integrally forming the central cell element from an electrically conductive metal in a mold, said mold having its interior shaped so that the central cell element has: (1) an electrically conductive central barrier, (2) an electrically conductive peripheral flange around the periphery of the central cell element which forms the peripheral boundaries of electrode compartments located on both sides of the central barrier, and (3) electrically conductive bosses projecting outwardly from both sides of the central barrier.

The preferred method of integrally forming the unitary central cell element is by sand casting molten metal, preferably casting molten ferrous metal. Other methods of integrally forming this unitary central cell element are, of course, not excluded. For example, other methods of integrally forming the central cell element include die casting, powdered metal pressing and sintering, hot isostatic pressing, hot forging and cold forging.

Furthermore, it is within the scope and spirit of integrally forming this unitary, or one-piece, central cell element to utilize such metal forming techniques as the use of inserts, chills and cores in the integral formation of this central cell unit. In fact, the particular location of chills of particular metals has resulted in the surprising result of not only making a more uniform casting but simultaneously producing a central cell element with better electrical conductive properties. In so doing, these chills then turn into inserts, of course.

For certainty of definition, the meaning of chills, inserts and cores in metal structure forming will now be given as these terms are used by the present inventors. Chills are items placed in the mold which act as aids in casting the part. Their primary purpose is to control the cooling rate of the molten metal at specific locations in the mold. By controlling the cooling of the molten metal, metal shrinkage can more accurately be controlled thereby improving part quality through reduced imperfections and defects. Chills may or may not become an integral part of the casting and may, in some cases, act as inserts as well.

Inserts are those items placed in the mold to aid in the function of the mold; aid in the forming of the part; or which will become a functional part of the finished article. They retain their identity, to varying degrees, after the formation is complete. They are usually metallic, although any suitable material may be used. Inserts may, in some cases, act as chills as well.

Cores are items placed in the mold which serve to eliminate metal in unwanted areas of a casting. Cores are used in the mold where it would be impractical or impossible to form the mold in such a way as to eliminate the unwanted metal. A typical example would be a core used to create the internal cavity of a cast metal valve body. Cores may, in some cases, act as chills as well.

The particularly useful chills which turn into inserts to increase the electrical conductivity of the central cell element are located transversely to the central barrier and run into the bosses. The central barrier and bosses of the central cell element will be discussed below. Suffice it for now to say that the preferred inserts or chills used are made of a solid metal that has the bulk of the metal of the central cell element formed around them. Preferably the metal formed around them is formed by casting it in a molten state in a sand mold.

Cores in the central cell unit can be used also in forming the central cell element. For example, it will be seen below that it will be advantageous to have openings passing all the way through the central barrier of the central cell element in the monopolar cell units to improve circulation while such cores would be of no significant disadvantage in a bipolar cell unit so long as the central cell element has at least one liner or pan on one of its sides to prevent the mixing of anolyte or catholyte from the adjacent bipolar compartments.

The method of assembling the cell unit can further comprise the fitting of a suitable pan to one or both sides of the central cell element to protect the metal of the central cell element from corrosive attack by the electrolyte with which it is expected to be used.

The method of installing the cell preferably further comprises electrically and mechanically attaching a planarly disposed electrode element indirectly to each side of the cell's central cell element by welding these electrode elements to the pan which itself is welded directly or indirectly through an intermediate to the central cell element. These electrode elements can be the electrodes themselves at which the electrochemical processes occur, or they can be electrically conductive means for further conducting electricity to the actual electrodes themselves. Usually the electrodes have catalyst deposited upon them.

After the cell units are formed individually, they are then formed into a filter press type cell series by compressing them together with pressing means such as a hydraulic press, bolts or tie rods.

The present invention is suitable for use with the newly developed solid polymer electrolyte electrodes. Solid polymer electrolyte electrodes are an ion-exchange membrane having an electrically conductive material embedded in or bonded to the ion-exchange membrane. Such electrodes are well known in the art and are illustrated in, for example, U.S. Pat. Nos. 4,457,815 and 4,457,823. These two patents are hereby incorporated by reference for the purposes of the solid polymer electrolyte electrodes which they teach.

In addition, the present invention is suitable for use as a zero gap cell. A zero gap cell is one in which at least one electrode is in physical contact with the ion-exchange membrane. Optionally, both of the electrodes may be in physical contact with the ion exchange membrane. Such cells are illustrated in U.S. Pat. Nos. 4,444,639; 4,457,822; and 4,448,662. These patents are incorporated by reference for the purposes of the zero gap cells that they illustrate.

In addition, other electrode components may be used in the cell of the present invention. For example, the mattress structure taught in U.S. Pat. No. 4,444,632 may be used to hold the ion-exchange membrane in physical contact with one of the electrodes of the cell. Various mattress configurations are illustrated in U.S. Pat. No. 4,340,452. The mattresses illustrated in U.S. Pat. No. 4,340,452 may be used with both solid polymer electrolyte cells and zero gap cells. These patents are incorporated by reference for the purposes of the cell elements that they teach.

A better understanding of this invention will be better obtained by discussing its bipolar and monopolar aspects separately as follows.

A. Bipolar Electrode Type

The present invention is a method of making and assembling an improved cell structure used in forming a bipolar electrode type, filter press type electrolytic cell unit. This particular cell unit is capable of being combined with other cell units to form a cell series. In said series the cell structure is separated from adjacent cell structures by ion-exchange, permselective membrane separators or porous asbestos diaphragm separators except in chlorate cells wherein no separators are used when an alkali metal chloride brine, such as when sodium chloride brine is electrolyzed to produce the respective alkali metal chlorate, e.g., sodium chlorate. Although this invention also applies to electrolysis cells which employ no separator between the anode and cathode, nevertheless it is discussed primarily with respect to electrolysis cells which employ permselective ion exchange membrane separators in order to show where these separators would go. These membranes are sealably disposed between each of the cell structures so as to form a plurality of electrolysis cells. Each of said electrolysis cells preferably but not necessarily has at least one planarly disposed membrane defining and separating the anolyte compartment from the catholyte compartment of each electrolysis cell. The cell structure of this particular cell unit has a central barrier which physically separates the anolyte compartment of an electrolysis cell located on one side of the barrier from the catholyte compartment of an adjacent electrolysis cell located on the opposite side of the barrier. This central barrier has a planarly disposed foraminous, "flat plate" anode element situated in its adjacent anolyte compartment and a planarly disposed, foraminous, "flat plate" cathode element situated in its adjacent catholyte compartment. Both electrode element faces are substantially parallel to the membrane planarly disposed between them and to the central barrier. The central barrier has the anode element of the adjacent anolyte compartment electrically connected through it to the cathode element of the adjacent catholyte compartment.

These anolyte and catholyte compartments adjacent to the central barrier have a peripheral structure around their periphery to complete their physical definition. The cell structure also has an electrical current transfer means associated with it for providing electrical current passage through the central barrier from its adjacent catholyte compartment to its adjacent anolyte compartment. This cell structure includes anode element and cathode element stand-off means for maintaining the anode element and cathode element of the two electrolysis cells adjacent to the central barrier at predetermined distances from the central barrier.

The improvement of this particular cell structure comprises forming the central barrier, the anolyte element and catholyte element compartment peripheral structures, the anode stand-off means, the cathode stand-off means, and at least part of the electrical current transfer means into a unitary central cell element from metal.

The invention employs the castable metal as part of the electrical current transfer means which transfers electricity through the central barrier from the adjacent catholyte compartment to the adjacent anolyte compartment. Preferably this metal is ductile iron.

The central cell element is formed in such a fashion so as to provide the structural integrity required to physically support the adjacent electrolyte compartments while loaded with electrolyte as well as to support the associated electrolysis cell appurtenances which are desired to be supported by the unitary central cell element.

The anode element stand-off means and that part of the electrical current connecting means located in the central cell element on the anolyte side of the central barrier are combined into a multiplicity of anode bosses projecting a predetermined distance outwardly from the central barrier into the anolyte compartment adjacent to the central barrier. These anode bosses are capable of being mechanically and electrically connected either directly to the anode element of said anolyte compartment or indirectly to said anode element through at least one compatible metal intermediate directly situated in an abutting fashion between said anode element and said anode bosses. Preferably these anode bosses all have ends which are flat surfaces which preferably line in the same geometrical plane.

The cathode element stand-off means and that part of the electrical current connecting means located on the catholyte side of the central barrier are combined into a multiplicity of cathode bosses projecting a predetermined distance outwardly from the central barrier into the catholyte compartment adjacent to the central barrier. These cathode bosses are capable of being mechanically and electrically connected either directly to the cathode element in said adjacent catholyte compartment or indirectly to the cathode element through at least one weldably compatible metal intermediate directly situated in an abutting fashion between said cathode element and said cathode bosses. Preferably these cathode bosses all have ends which are flat surfaces and which preferably lie in the same geometric plane.

The invention preferably further comprises anode bosses being spaced apart in a fashion such that anolyte can freely circulate through the totality of the otherwise unoccupied adjacent anolyte compartment, and, likewise, said cathode bosses being spaced apart in a fashion such that catholyte can freely circulate throughout the totality of the otherwise unoccupied adjacent catholyte compartment.

Preferably the material of the unitary central cell element is selected from the group consisting of iron, steel, stainless steel, nickel, aluminum, copper, chromium, magnesium, tantalum, cadmium, molybdenum, zirconium, lead, zinc, vanadium, tungsten, iridium, rhodium, cobalt, alloys of each, and alloys thereof.

More preferably the metal of the central cell element is selected from the group consisting of ferrous metals. Ferrous metals are defined herein to mean metallic materials whose primary constituent is iron.

A further element which this invention preferably includes is an anolyte side liner made of a metal sheet fitted over those surfaces on the anolyte compartment side of the cell structure which would otherwise be exposed to the corrosive environment of the anolyte compartments. These liners are also herein referred to as pans.

Preferably this anolyte side liner is an electrically conductive metal which is essentially resistant to corrosion due to the anolyte compartment environment, and preferably the metal liner is formed with caps so as to fit over and around the anode bosses with the liner being connected to the unitary central cell element at the anode bosses more preferably connected at the ends of the anode bosses.

And preferably the invention comprises having the liner sufficiently depressed around the spaced anode bosses toward the central barrier in the spaces between the bosses so as to allow free circulation of the anolyte between the lined unitary central cell element and the membrane of the adjacent anolyte chamber. Note that the liner replaces the unitary central cell element surface adjacent to the anolyte chamber as one boundary contacting the anolyte.

More preferably, the metal liner or pan is connected to the anode bosses by welding through a metal intermediate which is disposed between the bosses and the liner with the metal of the metal intermediate being weldably compatible with both the metal of the anolyte side liner and the metal of which the unitary central cell element is made, that is weldably compatible with both metals to the point of being capable of forming a solid solution with them at welds of them upon their welding.

In most cases, such as in the construction of chlor-alkali cells, it is preferred that the unitary cell element be made of a ferrous material and the anolyte side liner or pan be made of a metallic material selected from the group consisting of titanium, titanium alloys, tantalum, tantalum alloys, niobium, niobium alloys, hafnium, hafnium alloys, zirconium and zirconium alloys.

In situations where the anolyte side liner metal is not weldably compatible with the metal of the unitary cell element, then in order to be able to weld the liner to the structure, metal coupons are one type of metal intermediate which are suitable to be situated in an abutting fashion between the anode bosses and the anolyte side liner. Each coupon has at least two metal layers bonded together, with the outside metal layer of one side of the coupon abutting the anode boss and the outside metal layer of the opposite side of the coupon abutting the anolyte side liner. The metal layer of the coupons which abuts each anode boss is weldably compatible with the material of which the anode bosses are made and accordingly being welded to said anode bosses. The metal layer of that side of the coupons abutting the anolyte side liner is weldably compatible with the metallic material of which the anolyte side liner is made and accordingly is welded to said liner so that the liner is welded to the anode bosses through the coupons. In some instances wafers made of a single metal or metal alloy serve quite well as intermediates.

In most cases, it is preferred that the anolyte side liner be made of titanium or a titanium alloy, and the castable material from which the unitary central cell element be made is a ferrous material, most preferably ductile iron.

In the situation where the anolyte liner is titanium material and the anode bosses are a ferrous material, then it is preferred to have vanadium wafers serve as the weldably compatible metal intermediates interposed between the anode bosses and the adjacent anolyte side liner so that the titanium anolyte side liner can be welded to the ferrous material anode bosses through the vanadium wafers. Vanadium is a metal which is weldably compatible with both titanium and ferrous material.

In some instances it is preferred to have the metal intermediates, which are situated between the anode bosses and the adjacent anolyte side liner, joined to the ends of the anode bosses by a film-forming process. Spraying a hot liquid metal, such as vanadium, is one film-forming process. Another film-forming process is carried out by soldering or brazing the metal intermediate to the anode bosses.

In some rare occasions it is found that no metal intermediate is required to be used between the liner and the anode bosses, and that the anolyte side liner can be directly bonded to the anode bosses by welding.

Another way of connecting an anolyte liner to the central cell element when these metals are weldably incompatible is that where no metal intermediate is used, but wherein the anolyte side liner is bonded directly to the anode bosses by explosion bonding or diffusion bonding.

In most instances it is desired that the anolyte side metal liner or pan extends over the lateral face of the anolyte compartment peripheral structure so as to form a sealing face thereat for the membrane when the cell segments are squeezed together to form a cell series.

In most instances it is desired that the anolyte side liner be connected to the unitary central cell element at the ends of the anode bosses. However, this invention includes connecting the liner to the sides of these bosses and even connecting the liner to the central barrier between the bosses. Preferably, however, the anolyte side liner is welded to the ends of the anode bosses through an intermediate metal coupon or wafer.

A catholyte liner is usually required less frequently than an anolyte liner. However, there are many occasions, such as in high concentration caustic catholyte compartments, wherein a catholyte side liner is needed on the catholyte side of the unitary cell element. Thus this invention also comprises a catholyte side liner made of a metal sheet fitted over those surfaces of the unitary central cell element which would otherwise be exposed to the catholyte compartment of the adjacent electrolysis cell. Preferably this catholyte side metal liner is made of nickel. Herein this liner is also referred to as a pan.

This catholyte side liner is made from an electrically conductive metal which is essentially resistant to corrosion due to the catholyte compartment environment. Plastic liners may be used in come cases where provision is made for electrically connecting the cathode to the cathode bosses through the plastic. Also combinations of plastic and metal liners may be used. The same is true for anolyte side liners.

The catholyte liner is depressed sufficiently around the spaced cathode bosses toward the central barrier in the spaces between the bosses so as to allow free circulation of the catholyte between the lined unitary central cell element and the membrane of the adjacent catholyte chamber. Note that the liner replaces the unitary central cell element surface adjacent to the catholyte chamber as one boundary contacting the catholyte.

Unlike the anolyte side liner, it is usually not necessary that the metal catholyte side liner be connected to the cathode bosses through a metal intermediate. Hence, it is preferred that the metal catholyte side liner be directly connected to the cathode bosses by welding without a metal intermediate being disposed between the bosses and the liner. A metal intermediate can be used, however. If so, then the metal intermediate must be weldably compatible with both the metal of the catholyte side liner and the metal of which the unitary cell element is made.

In many instances it is desired that the central cell element be made of a ferrous material and the metal for the catholyte side liner be selected from the group consisting of ferrous materials, nickel, nickel alloys, chromium, magnesium, tantalum, cadmium, zirconium, lead, zinc, vanadium, tungsten, iridium, stainless steel, molybdenum, cobalt or alloys thereof.

In many instances it is desired that the metal of the unitary central cell element, of the catholyte side liner, and of the cathode of the adjacent electrolysis cell be all selected from the group consisting of ferrous metals.

In some instances it is preferred to have the metal intermediates situated between the cathode bosses and the adjacent catholyte side liner. The metal intermediates are similar to those discussed in attaching the anolyte side liner.

However, in most cases, the metal of the catholyte liner can be welded directly to the unitary cell structure without the need of a metal intermediate. Nickel is usually the most preferred catholyte liner material.

The catholyte side metal liner is formed so as to fit over and around the ends of the cathode bosses and is welded directly on one side of the liner to the bosses in a manner so as to provide an electrical connection between the unitary central cell element and the cathode element. The cathode element itself is directly welded to the opposite side of the cathode side liner.

As with the anolyte side liner, it is preferred that the catholyte side metal liner also extend over the lateral face of the catholyte compartment peripheral structure so as to form a sealing face thereat for the membrane when the cell segments are squeezed together to form a cell series.

In most instances it is desired that the catholyte side liner be connected to the unitary central cell element at the ends of the cathode bosses. However, this invention includes connecting the liner to the central barrier between the bosses.

B. Monopolar Electrode Type

The present invention is also a method of making and assembling cell structure for monopolar electrochemical cells assembled in a filter press configuration.

The central cell element for the monopolar cell unit is the same as that described above for the bipolar cell unit with the exception that each monopolar cell element also has means for electrically connecting it to an external power source. These means may be added as a separate element to the central cell element or may be integrally formed with it. Otherwise, the monopolar central cell element may have the same physical appearance as does the bipolar central cell unit and is made of the same metals. It is also made the same way; e.g., by a single casting to make an integral unit of the central barrier, the peripheral flange, and the electrode bosses on both sides of the central barrier.

Of course, contrary to the bipolar situation, in the monopolar situation, the bosses on both sides of the central barrier are of the same kind; i.e., the bosses on both sides are all anode bosses or they are all cathode bosses. They are not such that they will be anode bosses on one side and cathode bosses on the other side as is the case with bipolar electrodes. The terminal cells for a monopolar stack are end cells with only one side requiring an electrode.

Note, that it is customary in the monopolar cell field to call a group of filter press type cells a "cell stack" instead of a "cell series". However, in this application, cell stack and cell series are used interchangeably.

The single electrical polarity of the monopolar electrode also forces the electrolyte compartments located on both sides of the central cell element to be the same kind; that is, these adjacent compartments will either be both anolyte compartments or they will both be catholyte compartments.

The central cell element is formed so as to provide the structural integrity to support the cell weight. It also provides the electrical current pathway to the two electrodes electrically connected on both sides of it if it is electrically connected as an anode, or vice versa if it is electrically connected as a cathode.

The liners discussed in the above subsection on bipolar electrode cell units are much the same as are those for the monopolar electrode cell units. They may be alike in appearance and they serve the same function of protecting the unitary central cell element from electrochemical attack.

Of course, unlike the bipolar anolyte and catholyte side liner or pans discussed above for the bipolar electrode central cell element wherein each bipolar central cell unit had an anolyte side pan on one of its sides and a catholyte side pan on its other side, the monopolar central cell element has either anolyte side pans on both of its sides or it has catholyte side pans on both of its sides depending on whether the monopolar central cell element is to be used as an anode or as a cathode. Note, if the catholyte concentration is below about 22% at a temperature below about 85° C. it may not be necessary to have a catholyte side liner. These monopolar anolyte and catholyte pans are made from the same materials and by the same methods as are those described above for the bipolar central cell element. The monopolar anolyte and catholyte side pans are also attached to the monopolar central cell element in the manner described above for their counterpart bipolar anolyte and catholyte pans.

The monopolar electrode elements are like those described for the bipolar electrode cell unit described above and are attached in the same way. Like the bipolar electrode elements, the monopolar electrode elements do not necessarily have to be the electrodes themselves, electrodes being defined as the place where the electrochemical reactions are initiated. The electrode elements can be members which themselves conduct electricity to the anodes and from the cathodes. One example of this is shown by the expanded metal screens 35 and 36 and the anode 31 and cathode 32 illustrated in FIG. 2 of U.S. Pat. No. 4,247,376 issued to R. M. Dempsey and A. B. LaConti on Jan. 27, 1981, which patent is hereby incorporated by reference.

Nozzles are preferably a casting of titanium or nickel and of a shape to fit in channels or notches in the peripheral flange.

Bipolar cells utilize both catholyte and anolyte nozzles while monopolar cells utilize one or the other.

BRIEF DESCRIPTION OF THE DRAWING

The invention can be better understood by reference to the drawing illustrating the preferred embodiments made by the method of the invention, and wherein like reference numerals refer to like parts in the different drawing figures.

A. Bipolar Electrode Type

B. Monopolar Electrode Type

Figure 2:
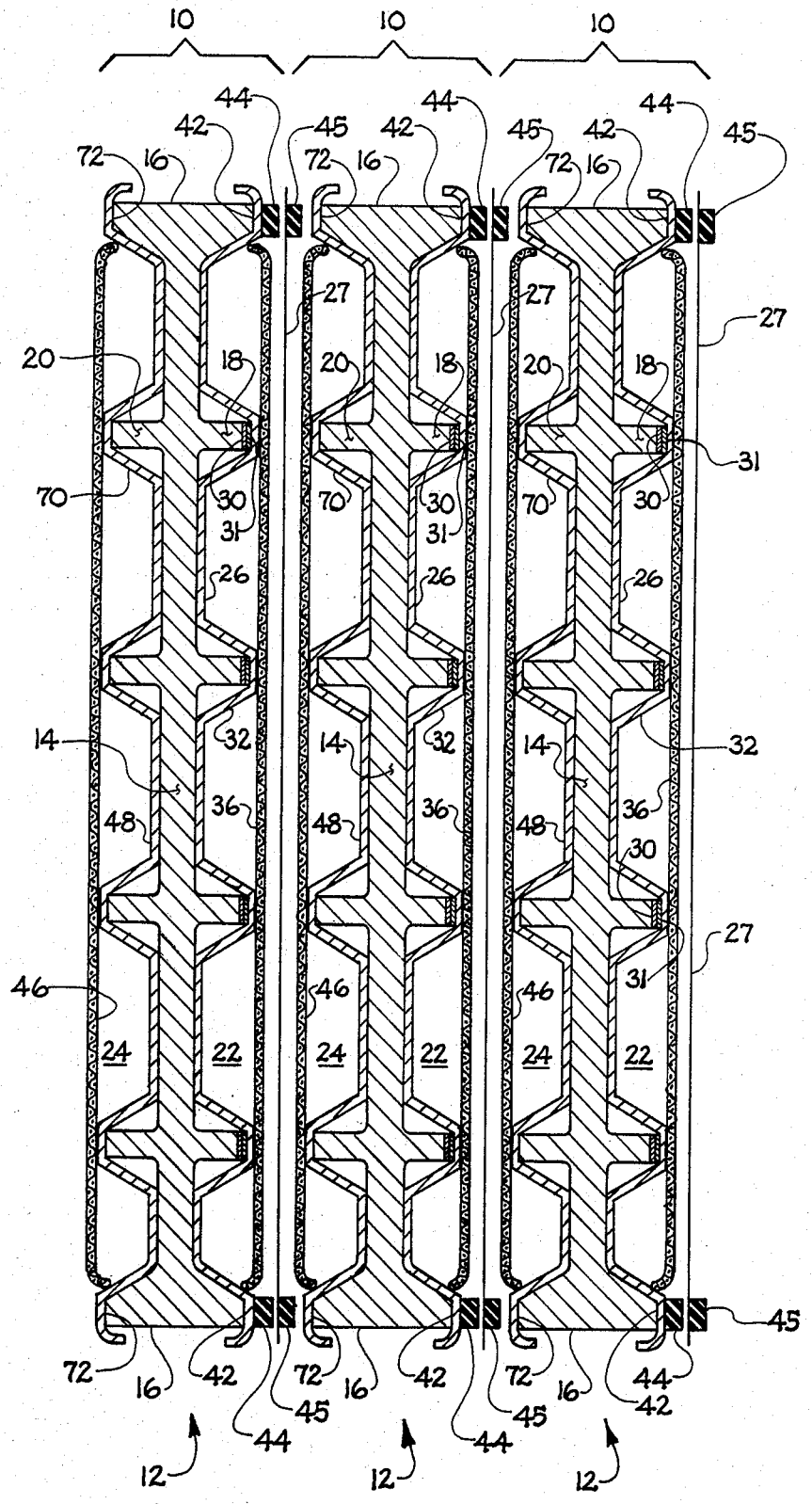
FIG. 2 is a cross-sectional side view of three bipolar filter press type cell units 10 employing the unitary cell elements 12, said cell units shown as they would appear in a filter press cell series, said cross section being taken along and in the direction of line 2—2 in FIGS. 4 and 5.
Figure 6:
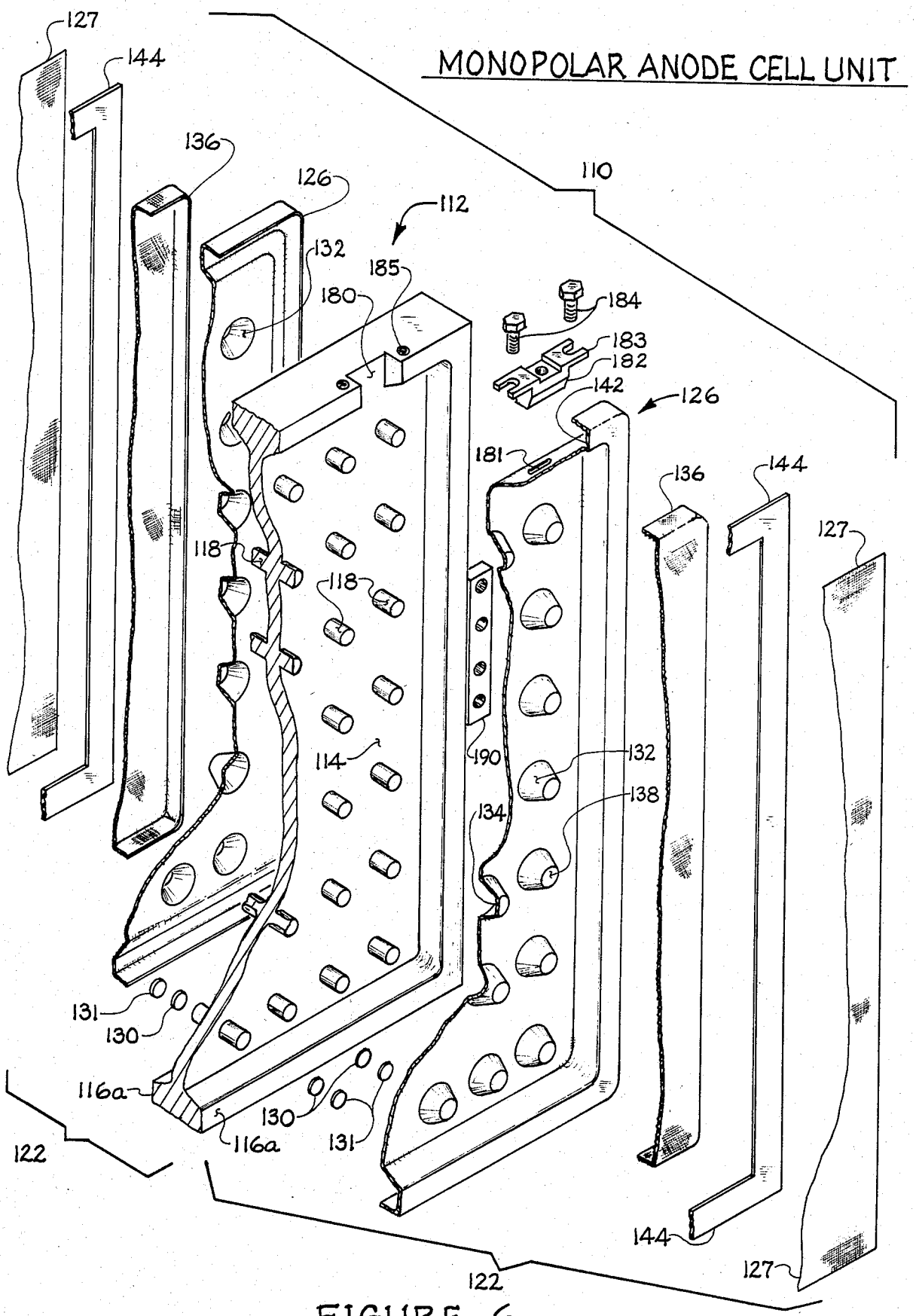
Figure 7:
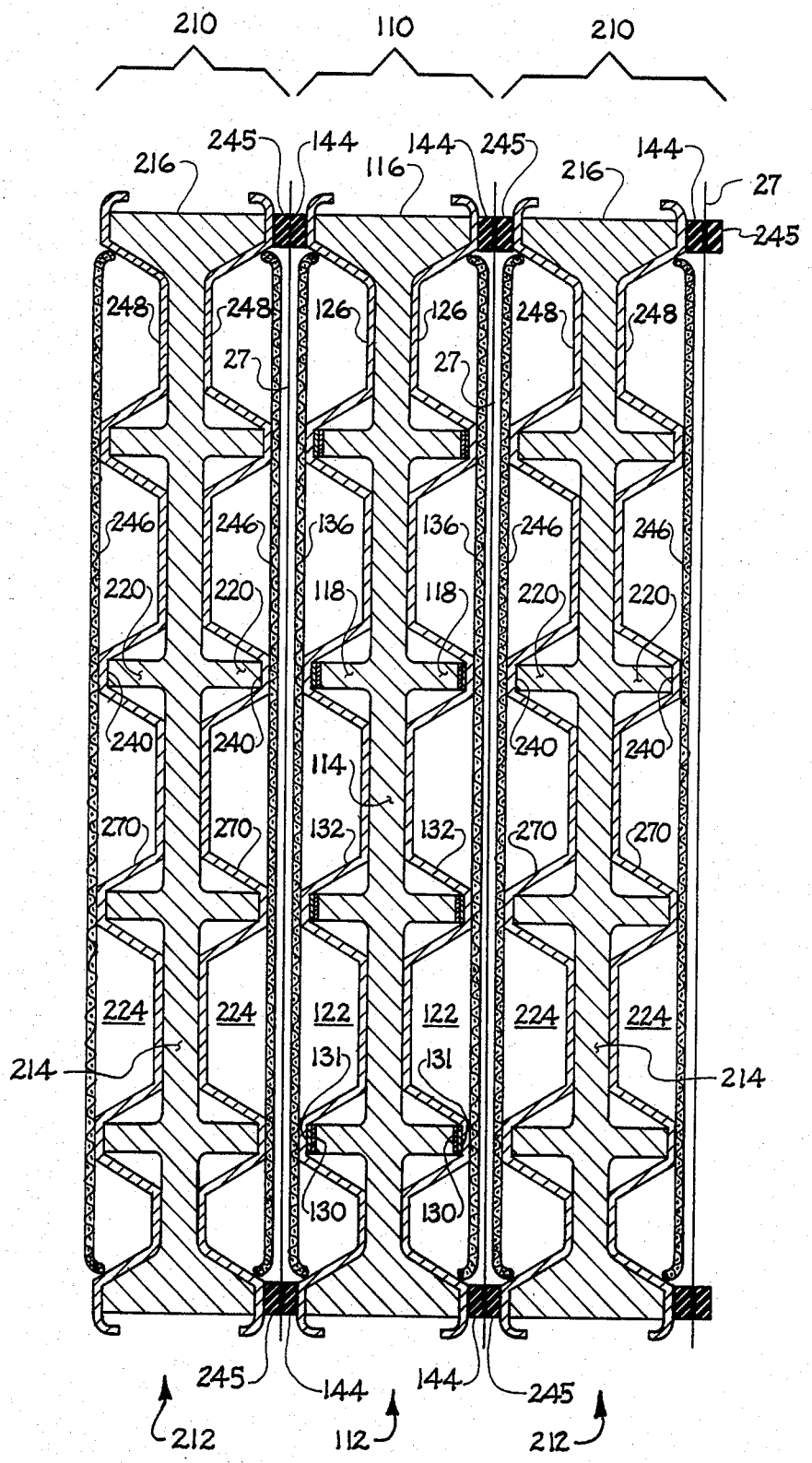
Figure 8:
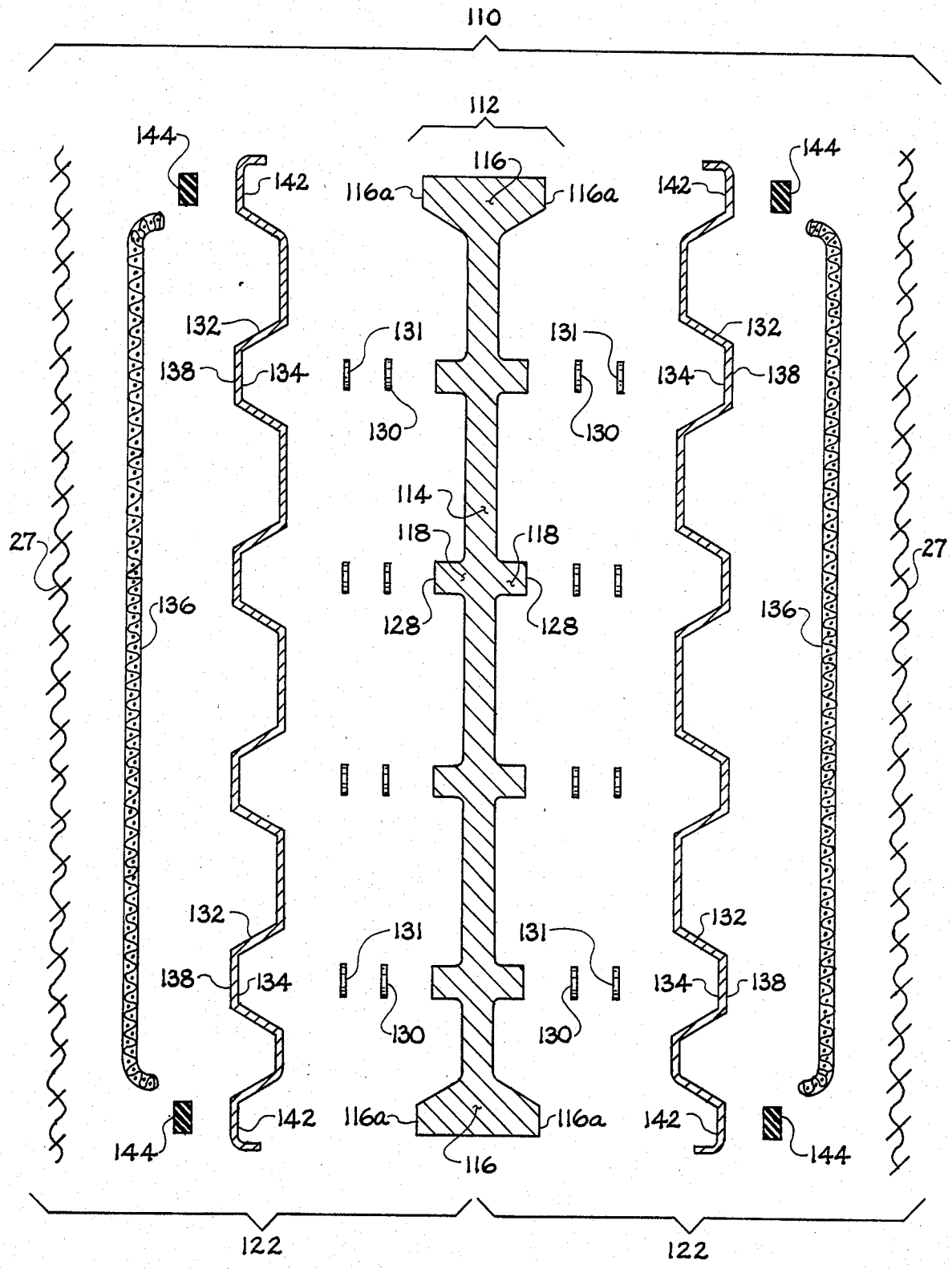
Figure 9:
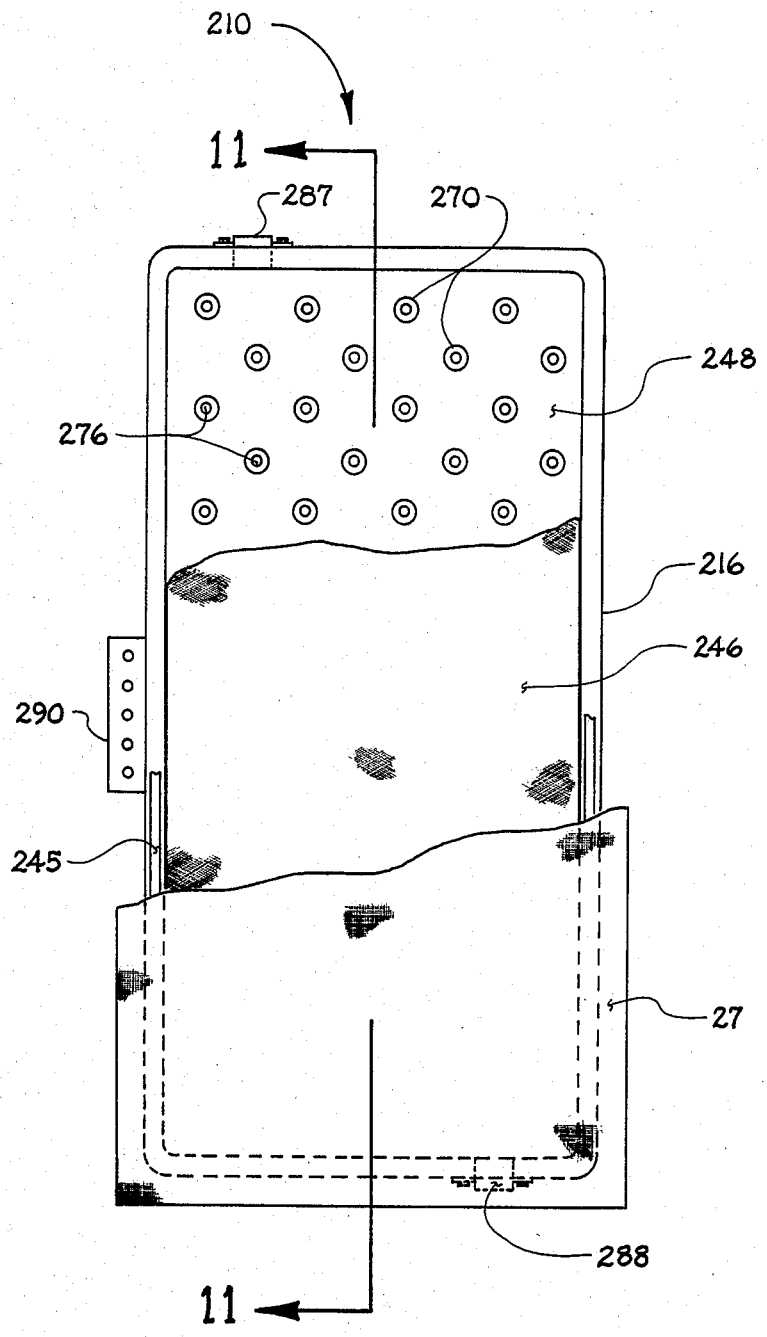
Figure 10:
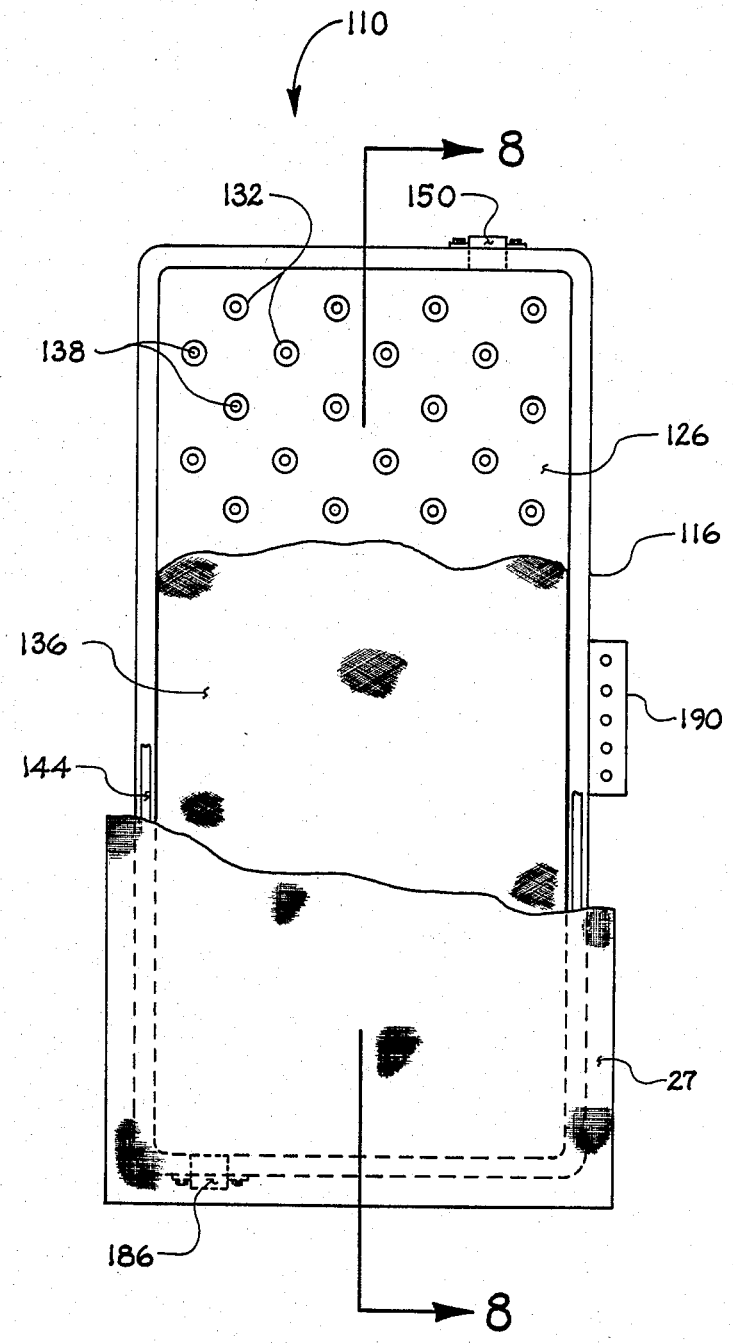
Figure 11:
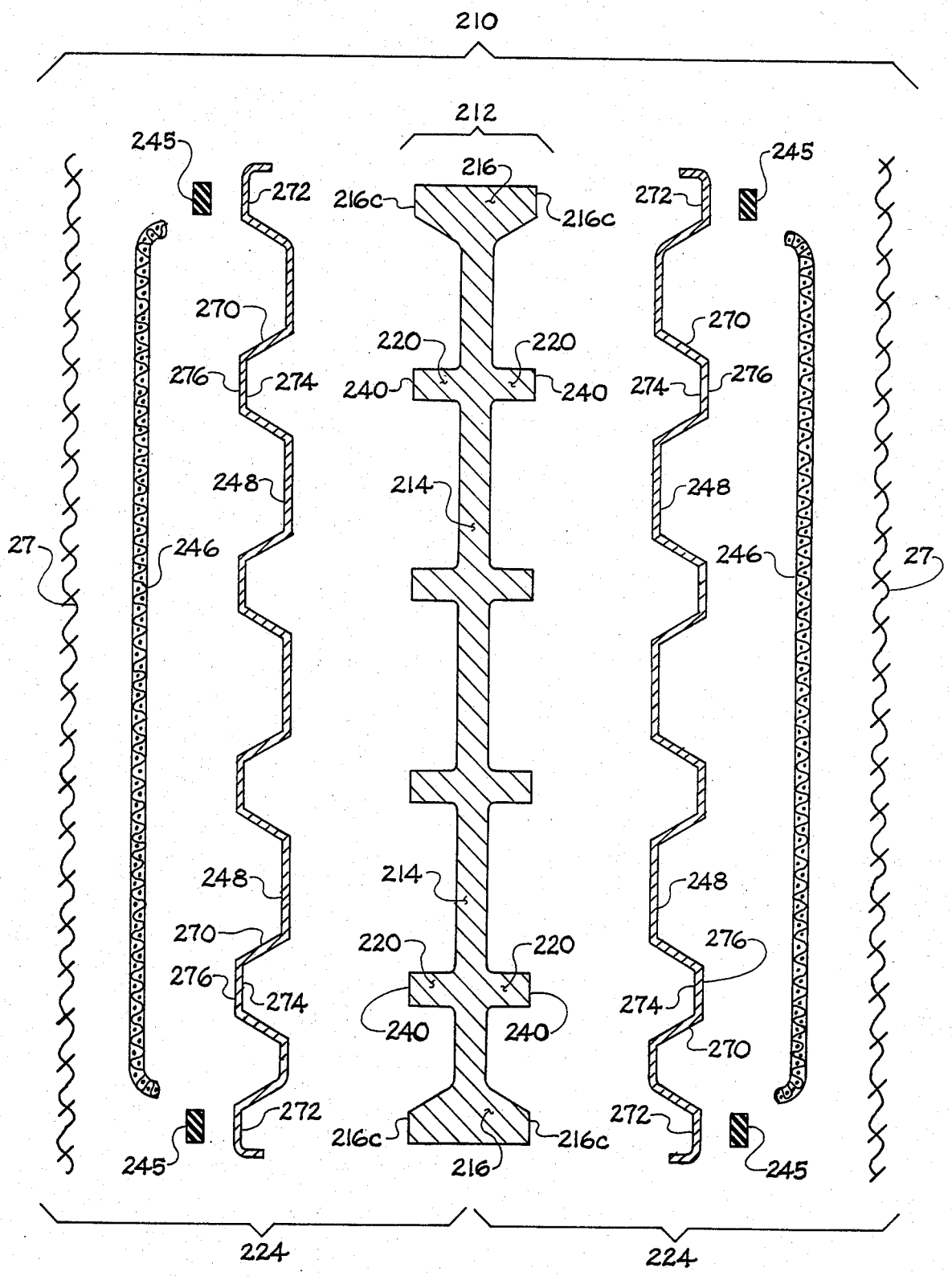

FIG. 6 is an exploded, partially broken-away perspective view of a monopolar unitary central cell element 112 made according to the method of this invention and which is shown with accompanying parts forming one monopolar anode type filter press cell unit 110 of a cell series of similar cell units which alternate between anode and cathode cell units;

FIG. 7 is a cross-sectional side view of three monopolar cell units shown in the same manner as they would appear if they were taken as the three bipolar cell units of FIG. 2 were taken, that is the cell elements are shown in a filter press arrangement showing monopolar anode cell unit 110 fitted between two like monopolar cathode cell units 210;

FIG. 8 is an exploded, sectional side view of the cell structure used in forming a monopolar anode type, filter press type cell unit 110 made according to the method of this invention, said sectional view being taken along line 8—8 of FIG. 10 and said view showing only those element parts which actually contact the imaginary sectional cutting plane taken along line 8—8 in FIG. 10 in order not to obscure these elements by showing the other element parts which are behind the imaginary sectional view cutting plane and which are normally shown in a sectional view;

FIG. 9 is a partially broken-away elevation of a monopolar cathode type filter press type cell unit 210 which employs elements made according to the method of this invention;

FIG. 10 is a partially broken-away elevation of a monopolar anode type filter press type cell unit 110 which employs elements made according to the method of this invention; and FIG. 11 is an exploded, sectional side view of the cell structure used in forming a monopolar cathode type, filter press type cell unit 210 made according to the method of this invention, said sectional view being taken along line 11—11 of FIG. 9 and said view showing only those element parts which actually contact the imaginary sectional cutting plane taken along line 11—11 in FIG. 9 in order not to obscure these elements by showing the other element parts which are behind the imaginary sectional view cutting plane and which are normally shown in a sectional view.

DETAILED DESCRIPTION OF CELL STRUCTURAL ELEMENTS MADE ACCORDING TO THE METHOD OF THE INVENTION

A. Bipolar Electrode Type

Figure 1:
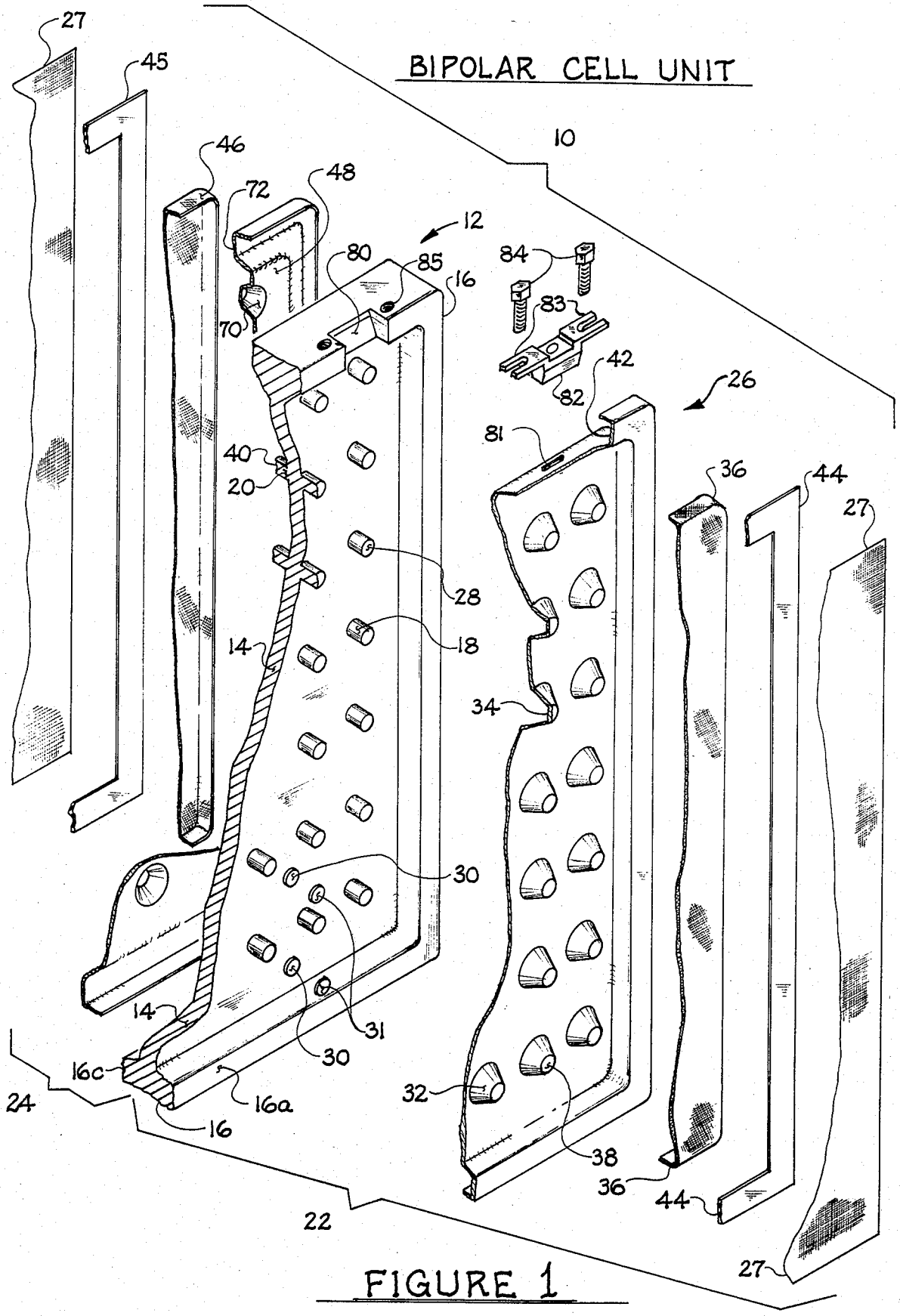
FIG. 1 is an exploded, partially broken-away perspective view of a bipolar unitary central cell element 12 made according to the method of this invention shown with accompanying parts forming one bipolar electrode type filter press type cell unit 10 of a cell series of such cell units.
Figure 3:
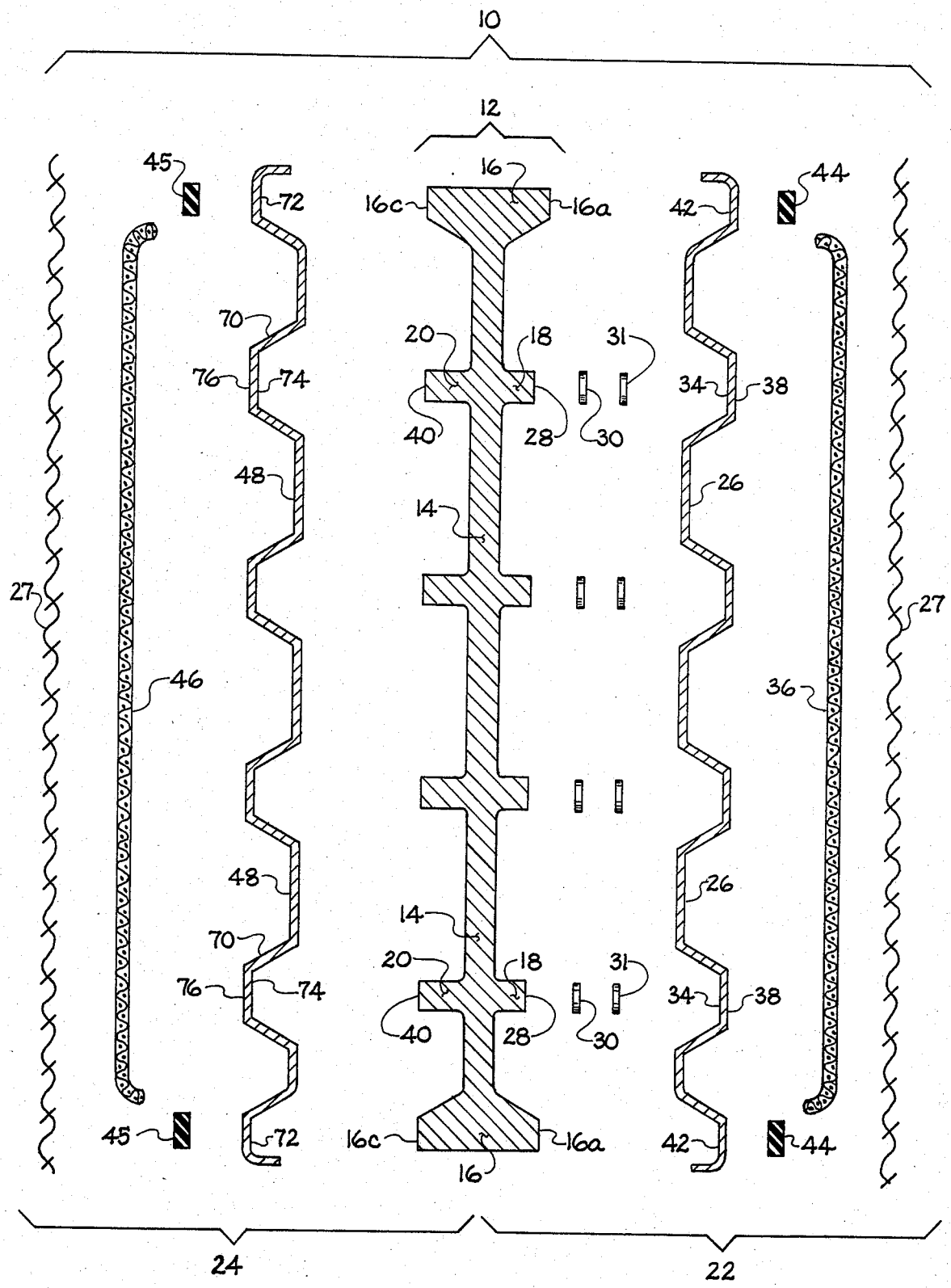
FIG. 3 is an exploded, sectional side view of cell structure used in forming a bipolar electrode type, filter press type cell unit 10 which employs the unitary central cell element 12, said sectional view being taken along the imaginary cutting plane represented by line 3—3 in FIGS. 4 and 5 in the direction indicated, but said sectional view only showing the cell unit parts which actually touch said imaginary plane in order to omit parts from this FIG. 3 which would otherwise tend to obscure these parts.

Referring to FIGS. 1, 2 and 3, a "flat plate" electrode type bipolar electrode type, filter press type electrolysis cell unit 10 is shown employing the preferred embodiment of the unitary central cell element 12 made according to the method of this invention.

In the preferred embodiment, unitary central cell unit 12 is made of cast ductile iron. It has a solid central barrier 14, a peripheral flange 16 extending laterally from both sides of the periphery of the central barrier 14, protruding and spaced-apart anode bosses 18, and protruding and spaced-apart cathode bosses 20.

By having these parts all cast into one unit 12, many problems are simultaneously eliminated or greatly reduced. For example, most of the warpage problems, fluid leakage problems, electric current maldistribution problems, and complications of cell construction on a mass production basis are greatly alleviated. This simplicity of cell design allows cell units to be constructed which are much more reliable, but which are constructed at a much more economical cost.

Referring to FIGS. 1, 2 and 3, an anolyte compartment 22 of an adjacent electrolysis cell can be seen on the right side of central cell element 12. On the left side of cell structure 12, a catholyte compartment 24 of a second adjacent electrolysis cell can be seen. Thus cell element 12 separates one electrolysis cell from another. One very important feature in cells of this type is to transmit electricity from one electrolysis cell to another as cheaply as possible.

On the anolyte compartment side (the right side on FIGS. 1, 2 and 3) of central structure 12, there is a liquid impervious anolyte side liner 26 preferably made from a single sheet of thin titanium, although it can be made from two or more sheets. This liner 26 is hot formed by a press in such a fashion so as to fit over and substantially against the surfaces of the unitary central cell unit 12 on its anolyte compartment side. This is done to protect the ductile iron of cell structure 12 from the corrosive environment of the anolyte compartment 22 (FIG. 3). Anolyte side liner 26 also forms the left boundary of anolyte compartment 22 with ion-exchange membrane 27 forming the right boundary (as shown in FIG. 3). Unitary cell element 12 is cast in such a fashion so that its peripheral structure forms a flange 16 which serves not only as the support for the peripheral boundary of the anolyte compartment 22 but also as the support for the peripheral boundary of the catholyte compartment 24. Preferably the titanium liner is formed with no stresses in it in order to provide a liner which atomic hydrogen can not attack as rapidly to form brittle, electrically non-conductive titanium hydrides. Atomic hydrogen is known to attack stressed titanium more rapidly. Avoiding these stresses in the liner is accomplished by hot forming the liner in a press at an elevated temperature of about 900° F. to about 1300° F. Both the liner metal and press are heated to this elevated temperature before pressing the liner into the desired shape. The liner may be held in the heated press for about fifteen minutes to prevent formation of stresses in it as it cools to room temperature. Other methods that can be used to form a pan may include vacuum, hydraulic, explosion, cold forming and other methods known in the art.

Titanium anolyte side liner 26 is connected to ductile iron cell element 12 by resistance or capacitor discharge welding. This welding is accomplished indirectly by welding the anolyte side liner 26 to the flat ends 28 of the cylindrically shaped, solid anode bosses 18 through vanadium wafers 30 and titanium wafers 31 which themselves are welded to the vanadium wafers 30. Vanadium is a metal which is weldable itself and which is weldably compatible with titanium and iron. Weldably compatible means that a joint of sufficient mechanical strength and electrical conductivity is formed. This is often accomplished by welding two or more metals together such that they form a ductile solid solution. Titanium and iron are not weldably compatible with each other, but both are weldably compatible with vanadium. Hence, vanadium wafers 30 are used as an intermediate metal between the iron anode bosses 18 and the titanium liner 26 to accomplish the welding of them together to form an electrical connection between liner 26 and central cell element 12 as well as form a mechanical support means for central cell element 12 to supporting anolyte side liner 26. For better welding of a thin titanium liner 26 to iron anode bosses 18 the second wafer 31 made of titanium is welded to the outside of the vanadium wafers 30 before the welding of liner 26 to the anode bosses 18 of central cell element 12.

The preferred fit of the anolyte side liner 26 against the central cell element 12 can be seen from the drawing (FIG. 2). The liner 26 has indented hollow caps 32 pressed into it. These caps 32 are frustroconically shaped, but are hollow instead of being solid as are the anode bosses 18. Caps 32 are sized and spaced so that they fit over and around anode bosses 18. Caps 32 are sized in depth of depression so that their interior ends 34 abut the titanium wafers 31 after the titanium wafers 31 and the vanadium wafers 30 have been welded to the flat ends 28 of the anode bosses 18. The shape of these bosses and caps is optional. They could be square shaped or any other convenient shape. However, preferably their ends 28 are all flat and preferably they all lie in the same imaginary geometrical plane. In fact the anode bosses 18 and caps 32 can be shaped and located so as to guide anolyte and gas circulation in the anolyte compartment 22.

The titanium anolyte side liner 26 is resistance or capacitor discharge welded at the interior ends 34 of its indented caps 32 to the ductile iron ends 28 of anode bosses 18 through the interposed, weldably compatible, vanadium wafers 30 and the titanium wafer 31.

Anode element 36 is a substantially flat sheet of expanded metal, punched plate, metal strips or woven wire made of titanium. In this preferred embodiment anode element 36 is the anode itself and it has a catalyst coating containing an oxide of ruthenium. It is welded directly to the outside of the flat ends 38 of indented caps 32 of titanium liner pan 26. These welds form an electrical connection and a mechanical support means for anode 36. Other catalyst coatings can be used.

Again it should be emphasized that the anode element 36 need not be the anode itself, but that it can rather be a current distributing planar surface which conducts electricity to the anode either directly or indirectly through a mattress or other electrode elements.

In FIG. 2 membrane 27 is seen to be disposed in a flat plane between the anode element 36 of the one filter press cell unit 10 and the cathode element 46 of the next adjacent filter press cell unit 10 so as to sharply define the anolyte and catholyte compartments of the electrochemical cell located between the central barrier 14 of each of the two adjacent unitary central cell elements 12.

Representative of the types of permselective, ion-exchange membranes envisioned for use with the structure made according to this invention are those disclosed in the following U.S. Pat. Nos.: 3,909,378; 4,329,435; 4,065,366; 4,116,888; 4,126,588; 4,209,635; 4,212,713; 4,215,333; 4,270,996; 4,123,336; 4,151,053; 4,176,215; 4,178,218; 4,340,680; 4,357,218; 4,025,405; 4,192,725; 4,330,654; 4,337,137; 4,337,211; 4,358,412; and 4,358,545. These patents are hereby incorporated by reference for the purpose of the membranes they disclose.

Of course, it is within the purview of this invention for the electrolysis cell formed between the two cell segments to be a multi-compartment electrochemical cell using more than one membrane, e.g., a three-compartment cell with two membranes spaced from one another so as to form a compartment between them as well as the compartment formed on the opposite side of each membrane between each membrane and its respective adjacent filter press cell unit 10.

The location of anode element 36 within anolyte compartment 22 with respect to the titanium lined central barrier 14 is determined by the relationships between the lateral extension of flange 16 from central barrier 14, the extension of anode bosses 18 from the central barrier 14, the thickness of the vanadium wafers 30, the thickness of anolyte side liner pan 26, and the like. It can be readily seen that anode element 36 can be moved by changing the extension of anode bosses 18 from the central barrier 14. It may be preferred, however, that the flange 16 on the anolyte side of central barrier 14 extend the same distance as do the anode bosses 18 from the central barrier 14. This adds to the simplification of construction of unitary central cell element 12 because, with this circumstance, a machine metal planar can plane both the end surfaces 28 of anode bosses 18 as well as the anolyte side liner lateral face **16*a* at the same time in a manner so as to form these surfaces into surfaces which all lie in the same geometrical plane. The same preference is true for like surfaces on the catholyte side 16*c* of unitary central cell element 12, i.e., it may be preferred that the flat ends 40 of cathode bosses 20 and the lateral surface 16*c* of flange 16 which lies on the catholyte side of structure 12** all be machined so as to all lie in the same geometrical plane. A departure from this preference can be used to generate considerable distance between an electrode element and the membrane, for example, to accommodate a mattress or to produce an electrolytic gap.

For fluid sealing purposes between membrane 27, and flange surface **16*a*, it is preferred for anolyte liner 26 to be formed in the shape of a pan with an off-set lip 42 extending around its periphery. Lip 42 fits flush against the anolyte side of lateral face 16*a* of flange 16, this lateral face 16*a* being located on the anolyte side of the cell structure 12. The periphery of membrane 27 fits flush against a first peripheral gasket 44 which itself fits against anolyte liner lip 42. A second peripheral gasket 45 fits flush against the other side of the periphery of membrane 27. In a cell series, as shown in FIG. 2, the gasket 45 fits flush against the lateral face 16*c* of the flange 16 on the catholyte side of the next adjacent cell structure 12 and flush against membrane 27 when there is no pan 48**. Various gasket selections can be made to optionally accommodate a mattress or produce an electrolyte gap.

Although membrane 27 is shown having two gaskets 44, 45 on each of its sides around its total periphery, this cell structure permits the use of only one gasket on either side of the membrane.

The cathode side of the bipolar central cell element 12 is on the opposite side of the central element from the anode side discussed at length above. On this cathode side there is shown a catholyte liner or pan 48. Sometimes this liner pan 48 is desired to be present, but often it is not necessary for it to be present. For example, in the electrolysis of sodium chloride brine to produce caustic in the catholyte compartment at concentrations below about 22% at catholyte temperatures below about 85° C., the iron central cell element 12 would usually not need a nickel liner 48 to protect it from the catholyte. But for such brine electrolysis at catholyte temperatures above about 85° C. and caustic concentrations above about 22%, then a liner such as nickel pan 48 is usually required to protect the iron central cell element 12 from corrosion by the catholyte. However, back on the anolyte side of the central cell element, a protective liner such as titanium pan 26 is often needed to prevent corrosion of a central cell element 12 made of a ferrous metal. The catholyte side liner 48 will be further discussed below.

Referring to FIGS. 2 and 3, therein the catholyte side (the left side) of bipolar cell element 12 is seen to appear as the mirror image of its anolyte side in this most preferred embodiment. The flange 16 forms the peripheral boundary of the catholyte compartment 24, while the nickel liner pan 48 and membrane 27 form its remaining boundaries. Spaced cathode bosses 20 may be solid, frustronconically shaped protrusions extending outwardly from central barrier 14 into catholyte compartment 24. The preferred frustrums of cones will closely approach a right cylinder. The shape of these cathode bosses 20 is optional. They are preferably flat on their ends 40, and these ends 40 preferably all lie in the same geometrical plane. This also applies to the indented caps 70 of the catholyte side liner 48 discussed below. These cathode bosses 20 and cathode pan caps 70 can be shaped and located so as to guide the catholyte and gas circulation.

The ends of the bosses may have various shapes that will aid in the welding process, e.g., a machined ring machined onto the end of the substantially flat boss.

When a metal liner is desired on the catholyte compartment side of unitary central cell element 12, it can easily be provided in the same manner and with similar limitations as is the anolyte compartment side liner 26 provided for anolyte compartment side of cell element 12, described above. Referring to FIGS. 1, 2, 3, and 4, such a catholyte side liner 48 is shown. It is made of a metal which is highly resistant to corrosive attack from the environment of the catholyte compartment 24. The metal must also be sufficiently ductile and workable so as to be pressed from a single sheet of metal into the non-planar form shown. This includes being capable of having the frustroconically shaped cathode boss indented caps 70 pressed into the single sheet. Of course, these cathode boss caps 70 must be spaced so that they fit over and around the spaced cathode bosses 20 as well as the other parts of the side of the central cell element 12 which would otherwise be exposed to the environment of the catholyte compartment 24. It is preferred that this catholyte side liner 48 have an indented lip 72 extending around its periphery in a fashion so as to flushly abut the lateral face **16*c* of flange 16 on the side of central cell element 12 which is adjacent to the catholyte compartment 24. Liner 48 is preferably connected to central cell element 12 by resistance or capacitor discharge welding of the liner caps' internal ends directly, in an abutting fashion, to the flat ends 40 of cathode bosses 20. That is, this is preferable if the metal of the liner 48 and the central support element 12 are weldably compatible with each other. If these metals are not weldably compatible, then metal intermediates or combinations of metal intermediates should be used which are weldably compatible with the metal of liner 48 and cell element 12. Such intermediates (not shown) are disposed between the cathode boss flat ends 40 and the liner caps' interior ends 74 which correspond to the boss ends 40. However, no such intermediates are necessary when the liner pan 48 is made of nickel and the central cell element 12** is made of ductile iron as is preferred to do.

Catholyte liner 48 is welded directly to the ends 40 of cathode bosses 20 by resistance or capacitor discharge welding the interior ends 74 of catholyte liner caps 70 to the end 40 of these bosses 20. Cathode element 46 is welded to the external end 76 of caps 70.

Metal intermediates for both the anolyte side and catholyte side may be metal wafers or metal coupons. By metal wafers, it is meant that the wafer be a single metal which is weldably compatible with both the metal of the cell element 12 and the metal of the respective liners 26 or 48. By metal coupons, it is meant at least two layers of different metals bonded together to make up such a metal intermediate 30. The metals of such a coupon can be bonded together by methods such as explosion or diffusion bonding, or they can in some cases be welded together. The shape and the size of these intermediates may vary to assist in the welding process. Note that the preferred method of attaching the anolyte side liner titanium pan 26 is to use a plurality of wafers; i.e., a vanadium wafer 30 welded to each central cell element boss cap 28 followed by the welding of a titanium wafer 31 to each of the vanadium wafers 30, followed by welding of the titanium pan 26 to the welded titanium wafers 31. The ultimate criteria for such intermediates are that: they be highly electrically conductive; the metal lying against the cell element 12 by weldably compatible with the cell element metal; and the metal layer of the coupon laying against the liner be weldably compatible with the metal of that liner. It should be noted that coupons can have more than two layers of metal. An example of one such coupon for the anolyte compartment side is a three layer explosion bonded coupon of titanium, copper and a ferrous metal.

It will be noticed that both the flat-surfaced anode element 36 and the flat-surfaced cathode element 46 have their peripheral edges rolled inwardly toward the cell element 12 away from the membrane 27. This may be done to prevent the sometimes jagged edges of these electrodes from contacting the membrane 27 and tearing it.

The cathode element 46 in this preferred embodiment of bipolar cell unit 10 is a foraminous, substantially planar sheet of nickel. Cathode element 46 is attached to nickel pan 48 by welding the cathode element 46 to the outer surface 76 of the caps 70 formed in the catholyte nickel liner pan 48. In this most preferred embodiment, nickel electrode element 46 has a catalytic coating upon it and serves as the cathode itself. It may be pressed against the membrane 27 as is the adjacent titanium anode element 36 pressed against the membrane so as to allow virtually no gap to exist between the membrane 27 and its adjacent electrode elements 36, 48. (See FIG. 2).

The preferred catalytic coating for nickel electrode 46 is a heterogeneous mixture of nickel oxide and ruthenium oxide. The preferred method for depositing this coating is found in Example 1 of U.S. Patent Application having the Ser. No. of 499,626 and the filing date with the U.S. Patent and Trademark Office of May 31, 1983; said application being commonly assigned with the present application to The Dow Chemical Company, a corporation chartered in the State of Delaware. Of course, the nickel electrode element 46 could be the cathode without a catalytic coating, or the cathode element 46 could merely be an electrical transfer agent of electricity coming from the cathode formed by other elements (not shown) embedded in or pressed against the membrane.

Figure 5:
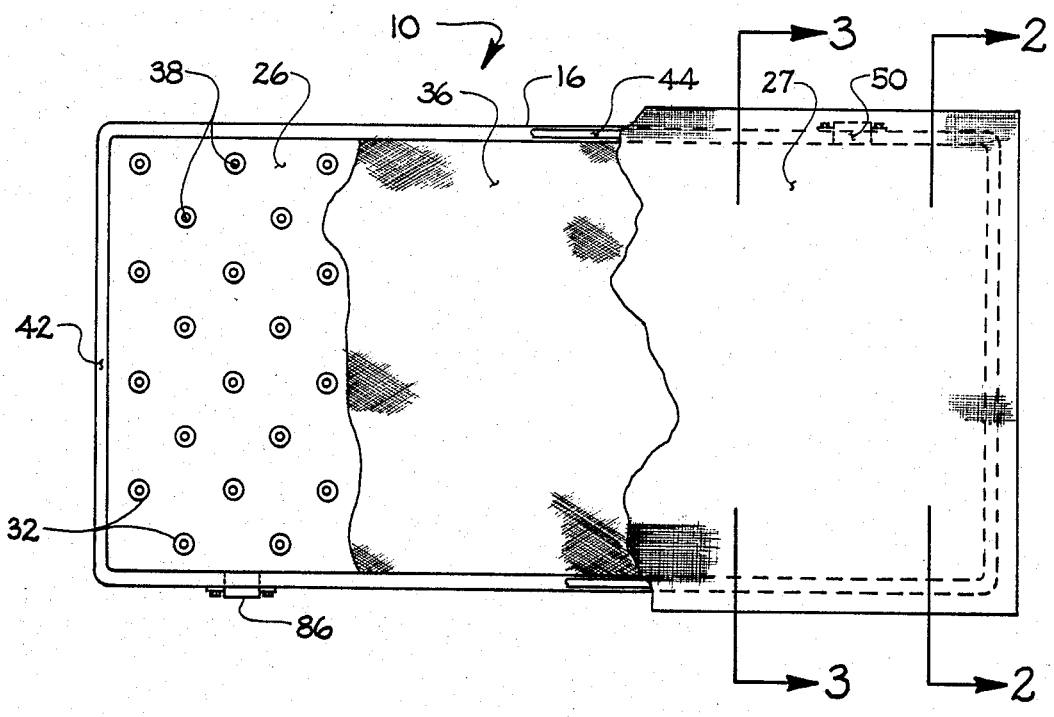
FIG. 5 is a partially broken-away front view of a bipolar electrode type, filter press type cell unit 10 which employs elements made according to the method of this invention and which is viewed from the anode side.

Both the anolyte compartment 22 and the catholyte compartment 24 have inlet and outlet means for introducing raw materials and removing product gases and liquids. These inlet and outlet means pass through the peripheral flange with compartment 22, 24 having an inlet means and an outlet means. The preferred inlet and outlet means is best illustrated by the anolyte compartment outlet means whose several parts (80–85 in FIG. 1 and 180–185 in FIG. 6) are generally referred to by reference number 50 (FIG. 5). Therein can be seen open-side channel 80 which was formed in the ductile iron peripheral flange 16 on its anolytic side; opening 81 cut in titanium pan 26; and formed in titanium nozzle 82. Opening 81 in pan 26 coincides with the boundaries of channel 80. Nozzle 82 is then sealingly welded to the hole 81 in the flange of pan 26 in a manner such that the bottom of nozzle 82 at least reaches the anolyte compartment 22, and the top of nozzle 82 extends at least to the top of flange channel 80 so that no anolyte products can contact the iron of flange channel 80. Bolt ear fittings 83 extend from the side of nozzle 82 so that nozzle 82 can be secured to flange 16 by bolts 84 screwed into drilled and threaded holes 85 formed in flange 16.

Other fabrication steps can be used to produce a pan with sealably welded nozzles wherein the nozzles are in a position to correspond with the channels.

An anolyte compartment entrance 86 like the anolyte compartment exit means 50 just described is formed on the bottom anolyte side of flange 16. A catholyte compartment exit means 87 and a catholyte compartment entry means 88 are formed, in, like manner as are the anolyte compartment exit means 50 with the exception that entrance 88 and exit 87 are formed in the flange on the catholyte side of central cell element 12 (See FIGS. 4–5), and with the further exception that the catholyte nozzles are made of nickel instead of titanium.

Figure 4:
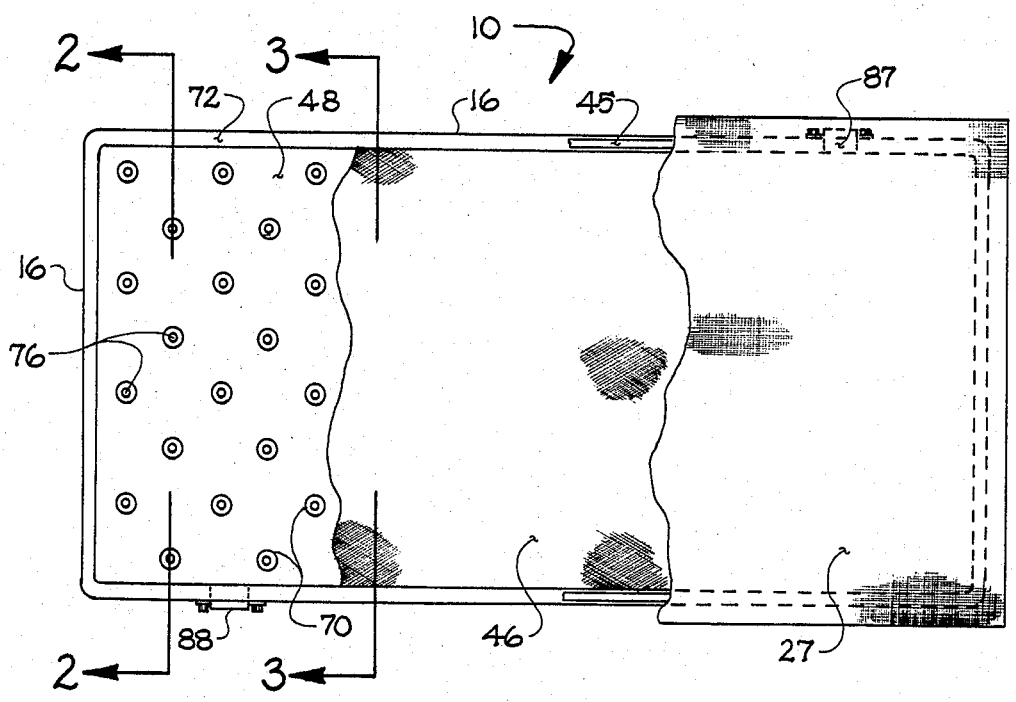
FIG. 4 is a partially broken-away front view of a bipolar electrode type filter press type cell unit 10 which employs elements made according to the method of this invention and which is viewed from the cathode side.

With sodium chloride brine as cell feed, the cell operates as follows. The feed brine is continuously fed into anolyte compartment 22 via anolyte compartment entrance means 86 while fresh water or dilute caustic solutions may be fed into catholyte compartment 24 via catholyte compartment entrance means 88 (FIGS. 4 and 5). Electric power (D.C.) is applied across the cell series in such a fashion so that the anode 36 of each electrolysis cell is positive with respect to the cathode 46 of that electrolysis cell; i.e., the positive electrical lead of the power source is electrically connected to the anode of the terminal cell unit at one end of the cell series, and the negative electrical lead of the power source is electrically connected to the cathode of the terminal cell unit at the other end of the cell series. Excluding depolarized cathodes or anodes, the electrolysis proceeds as follows. Chlorine gas is continuously produced at the anode 36; sodium cations are transported through membrane 27 to the catholyte compartment. In the catholyte compartment 24 hydrogen gas and an aqueous solution of sodium hydroxide are continuously formed. The chlorine gas and depleted brine continuously flow from the anolyte chamber 22 via anolyte chamber exit means 50 while the hydrogen gas and sodium hydroxide continuously exit the catholyte compartment 24 via catholyte chamber exit means 87. Depolarized electrodes can be used to suppress the production of hydrogen or chlorine or both if desired.

In operating the cell series as an electrolysis cell series for NaCl brine, certain operating conditions are preferred. In the anolyte compartment a pH of from about 0.5 to about 5.0 is desired to be maintained. The feed brine preferably contains only minor amounts of multivalent cations (less than about 80 PPB when expressed as calcium). Higher multivalent cation concentration is tolerated with the same beneficial results if the feed brine contains carbon dioxide in concentrations lower than about 70 ppm when the pH of the feed brine is lower than 3.5. Operating temperatures can range from 0° to 250° C., but preferably above about 60° C. Brine purified from multivalent cations by chelating ion-exchange resins after conventional brine treatment has occurred is particularly useful in prolonging the life of the membrane. A low iron content in the feed brine is desired to prolong the life of the membrane. Preferably the pH of the brine feed is maintained at a pH below 4.0 by the addition of hydrochloric acid.

Preferably the pressure in the catholyte compartment is maintained at a pressure slightly greater than that in the anolyte compartment, but preferably at a pressure difference which is no greater than a head pressure of about 305 mm foot of water for a conventional gap cell.

Preferably the operating pressure is maintained at less than 7 atmospheres.

Usually the cell is operated at a current density of from about 1.0 to about 4.0 amperes per square inch, but in some cases operating above 4.0 amps/in.$^2$ is quite acceptable.

Now to the case where a metal liner is desired on both sides of the cell structure in a chlor-alkali cell. In the example given above for electrolyzing sodium chloride brine, a catholyte side, single piece metal liner 48 made of nickel is desired when the caustic concentration in the catholyte compartment 24 is maintained above about 22 wt. % and the cell electrolyte operating temperature is maintained above about 80° C. This nickel liner 48 is formed, sized for, and fitted to the central cell element 12 in essentially the same manner as is the titanium liner 26 on the anolyte side. However, since nickel and steel are weldably compatible together themselves, there is no need to have a metal intermediate situated between them at the locations where the welds connecting the catholyte side liner 48 to the cathode boss ends 40 are located. This is not to say, however, that this invention excludes the use of weldably compatible metal intermediates between the cathode bosses 20 and the catholyte liner 48. A liner may be used on one side, on both sides, or on neither side of unitary cell element 12.

Now turning to a more general description of the bipolar cell element. Besides ferrous materials such as iron, steel and stainless steel, cell element 12 can also be formed from any other formable metal or metal alloy such as nickel, aluminum, copper, chromium, magnesium, titanium, tantalum, cadmium, zirconium, lead, zinc, vanadium, tungsten, iridium, rhodium, molybdenum, cobalt, and their alloys. Catholyte side liners 48 are usually chosen from these materials also, with the general exception of magnesium, aluminum, cadmium and zinc.

The anolyte side liner 26 and the catholyte side liners 48 are preferably made of sufficiently workable metallic materials as to be capable of a sheet of it being formed into the shape in which they are shown in the drawing. Of course, this sheet of anolyte side liner 26 can be formed from several sheets which are sealably welded together to form an impervious single sheet. This includes the ability to be pressed so that they have frustroconically shaped caps 32 and 70. It should also be understood that the invention is not limited to the caps 32, 70 being frustroconically shaped nor limited to the anode and cathode bosses 18 and 20 being frustroconically shaped. They can be shaped and located so as to direct the flow of electrolytes and gas within the compartments 22 and 24. Bosses 18 and 20 should have their ends 28 and 40 flat and parallel with the flat electrode surface to which they are going to be connected. The ends 28 and 40 of the bosses 18 and 20 should present sufficient surface area to which electrical connections can be made to their respective electrodes to provide an electrical path with sufficiently low electrical resistance. The bosses 18 and 20 should be spaced so they provide a fairly uniform and fairly low electrical potential gradient across the face of the electrode to which they are attached. They should be spaced so that they allow free electrolyte circulation from any unoccupied point within their respective electrolyte compartment to any other unoccupied point within that compartment. Thus the bosses will be fairly uniformly spaced apart from one another in their respective compartments. It should be noted here that although anode bosses 18 and cathode bosses 20 are shown in a back to back relationship across central barrier 14, they need not be. They can be offset from each other across barrier 14.

The materials from which anode and cathode bosses 18 and 20 are made are, of course, the same as that of the cell element 12 since part of this invention is to make them an integral part of that cell element.

As to the anolyte side and catholyte side liners 26 and 48, they are required to be electrically conductive, resistant to chemical attack from the electrolyte compartment environment to which they are exposed, and sufficiently ductile to form the indented caps 32, 70.

Of course, the metals from which anolyte side liner 26 and catholyte side liner 48 are made are usually different because of the different electrolyte corrosion and electrolytic corrosion conditions to which they are exposed. This is true not only in chlor-alkali cell electrolytes, but also in other electrolytes. However, some materials may be serviceable in both electrolytes. Thus the metals chosen must be chosen to fit the conditions to which they are going to be exposed. Typically titanium is the preferred metal for the anolyte compartment liner 26. Other metals suitable for such conditions can usually be found in the following group: titanium, titanium alloys, tantalum, tantalum alloys, niobium, niobium alloys, hafnium, hafnium alloys, zirconium and zirconium alloys.

The number of metals suitable for the catholyte side liner 48 is usually much larger than the number suitable for the anolyte compartment side principally due to the fact that most metals are immune from chemical attack under the relatively high pH conditions present in the catholyte and due to the electrical cathodic protection provided by the metal on the anolyte side of the cell structure 12. Nickel materials are usually preferred as the metals for the catholyte side liner. Other usually suitable liner 48 material includes nickel, steel, stainless steel, chromium, tantalum, zirconium, lead, vanadium, molybdenum, tungsten, iridium, cobalt and alloys of each of these metals.

As a general rule, the metal which is used for catholyte side liner 48 is also suitable for use in making the cathode 46. This is similarly true for the metal of the anolyte side liner 26 and its anode 36.

When a liner metal is used which is weldably incompatible with the metal of the cell structure 12, and when the liner 26 or 48 is to be connected to the cell structure 12 by welding, then metal intermediates are positioned between the cell structure bosses and the metal liner at the location where the welds are to be made. These metal intermediates may be in the form of a single metal wafer, in the form of a multilayered metal coupon, or in the form of a metal film formed either on the cell structure 12 or the liner 26 or 48.

B. Monopolar Electrode Type

The preferred embodiment of the monopolar cell structure made by the method of this invention is illustrated in FIGS. 6–10. Except for the arrangement and positioning of these cell elements, essentially the only difference between them and the bipolar cell elements are their electrical connection means. One difference in the prior art is that bipolar cell unit 10 is seen to have its longest dimension oriented in the horizontal direction while the monopolar anode cell unit 110 and the cathode cell 210 unit are seen to have their longest dimension in the vertical direction. This longest dimension distinction is only preferred; it is not critical for cells made from the present invention.

Thus it can be seen that the method of this invention produces cell element structural parts for assembling a monopolar cell series which can be used in a bipolar cell series by merely rearranging the liner pans and reconnecting the electrical connections. The thick central barrier provides not only the thickness to support the weight of either the monopolar or bipolar cell unit structures, but it also is sufficiently thick (at least about one centimeter) to provide a very low resistance electrical path for the monopolar cell units. This combination of features results in a novel, simple, interchangeable cell structural element which is economical to manufacture, economical to assemble with other cell parts to make either a monopolar or bipolar unit, which cell units are economical to operate, and which cell units have a very long, useful life.

In describing the monopolar cell parts illustrated in FIGS. 6–10, only a brief description of them is going to be given to them with recognizable cross-referencing numbering system for the parts of the monopolar cell units 110, 210 back to the like parts of the bipolar cell unit 10 of FIGS. 1–5. This numbering system will comprise adding 100 to the like part of the bipolar cell unit 10 to derive the reference number for the like part of the monopolar anode cell unit 110, and adding 200 to the like part of the bipolar cell unit 10 to derive the reference number for the like part of the monopolar cathode cell unit. The corresponding like parts of these three similar type of cell units are set forth in the following table.

Table of Like Parts with Correspondingly Derived Reference Numbers

| Names of Like Parts of the Three Different Cell Unit Types | Bipolar Unit Part Part Number | Monopolar Anode Unit Part Number | Monopolar Cathode Unit Part Number |
|---|---|---|---|
| Cell unit | 10 | 110 | 210 |
| Central cell element | 12 | 112 | 212 |
| Solid central barrier | 14 | 114 | 214 |
| Peripheral flange | 16 | 116 | 216 |
| Anolyte side of peripheral flange | 16a | 116a | — |
| Catholyte side of peripheral flange | 16c | — | 216c |
| Anode bosses | 18 | 118 | — |
| Cathode bosses | 20 | — | 220 |
| Anolyte compartment | 22 | 122 | — |
| Catholyte compartment | 24 | — | 224 |
| Anolyte side liner or pan | 26 | 126 | — |
| Permselective ion-exchange membrane | 27 | 127 | 227 |
| Flat ends of anode bosses | 28 | 128 | — |
| Vanadium wafers | 30 | 130 | — |

-continued

| Table of Like Parts with Correspondingly Derived Reference Numbers | | | |
|---|---|---|---|
| Names of Like Parts of the Three Different Cell Unit Types | Bipolar Unit Part Part Number | Monopolar Anode Unit Part Number | Monopolar Cathode Unit Part Number |
| Titanium wafers | 31 | 131 | — |
| Hollow caps (in anolyte liner pan) | 32 | 132 | — |
| Interior ends of hollow caps in anolyte liner pan | 34 | 134 | — |
| Anode element | 36 | 136 | 236 |
| Flat ends of indented caps of titanium liner pan | 38 | 138 | — |
| Flattened ends of cathode bosses | 40 | — | 240 |
| Off-set lip of anolyte liner pan | 42 | 142 | — |
| Gasket on anolyte side | 44 | 144 | — |
| Gasket on catholyte side | 45 | — | 245 |
| Foraminous metal cathode element | 46 | — | 246 |
| Catholyte side liner or pan | 48 | — | 248 |
| Anolyte compartment exit means | 50 | 150 | — |
| Cathode pan indented hollow caps | 70 | — | 270 |
| Cathode pan indented lip | 72 | — | 272 |
| Cathode pan liner cap's interior end | 74 | — | 274 |
| Cathode pan liner cap's exterior end | 76 | — | 276 |
| Open side channel | 80 | 180 | — |
| Opening in titanium pan | 81 | 181 | — |
| Titanium nozzle | 82 | 182 | — |
| Bolt fittings | 83 | 183 | — |
| Bolts | 84 | 184 | — |
| Threaded holes | 85 | 185 | — |
| Anolyte compartment entrance means | 86 | 186 | — |
| Catholyte compartment exit means | 87 | — | 287 |
| Catholyte compartment entrance means | 88 | — | 288 |

Of course, these monopolar anode and cathode cell elements 110, 210 each have an electrical connection means such as anode bus terminal 190 (FIG. 10) and cathode bus terminal 290 (FIG. 9). These connecting means are attached to their respective peripheral flange 116 and 216, respectively. Cathode bus terminal 290 appears on the left side of its central cell element while the anode bus terminal 190 appears on the right side of its central cell element. Otherwise this is the primary significant structural difference between the monopolar and bipolar cell units made by the method of this invention other than the rearrangement of cell parts when changing from a monopolar type filter press electrochemical cell series to a bipolar type filter press electrochemical cell series. In a bipolar cell unit in a bipolar series, one side has parts adapted for use in an anolyte environment whereas the opposite side has parts adapted for use in a catholyte environment. But if the parts are made such that they are interchangeable between monopolar and bipolar cell units, then all one has to do before assembling these parts is to determine what type of cell series he desires his particular cell series to be before he assembles parts taken from the group of parts made according to the method of this invention and according to the method of assembling this invention.

Thus when a monopolar anode cell unit 110 for this invention is desired, a titanium pan 126 is attached to each side of a central cell element 112, followed by the attachment of an anode element 136 to each of these pans 126. (See FIGS. 6–10). For the cathode cell units 210 for this monopolar filter press type of cell series, a nickel pan 248 is connected to each side of central cell element 212 followed by the attachment of a cathode element 246 to each of these nickel pans 248.

Each bipolar cell unit 10 for a bipolar filter press cell series is assembled as a monopolar anode unit on one side and as a monopolar cathode unit on the other. (See FIGS. 1–5). On its anode side a titanium liner 26 is attached to central cell element 12 followed by the attachment of an anode element 36 to the titanium pan 26, while on the opposite side of central cell element 12 a nickel liner 48 is attached to cell element 12 followed by the connection and attachment of cathode element 46.

Thus a generic method of making and assembling a cell unit for either a filter press cell series of both the monopolar and bipolar filter press type of electrochemical cell series has been described.

The necessary step in completing the assembly and definition of any filter press cell series is the manner of impressment of electrical power to the cell series. A bipolar cell series is formed by the connection of a positive electrical power source lead to one end of a cell series and a negative electrial power source lead to the other end of that cell series with the potential difference between these two leads being applied across the intervening cell units of the series. A monopolar cell filter press type electrochemical cell series is completely defined when alternating cell units of the series are connected to a positive electrical power source and a negative electrical power source. That is, every other cell unit of a monopolar cell series will be connected to a positive electrical power source with the other cell units being connected to a negative electrical power source.

Anode bus terminal 190 and cathode bus terminal 290 used to connect the power source to the monopolar anode cell unit and monopolar cathode cell unit, respectively, are preferred to be integrally cast with their respective central cell elements 112 and 212, but they need not be.

EXAMPLE 1

A cell structure specimen was cast of SA-216, grade WCB steel. The thickness of the central barrier was approximately ½" thick. The base diameter of the frustroconical boss was 3" and the top diameter was 1½". Overall dimensions of the structure were approximately 16"×20", with ten bosses located on each side (anode and cathode) and directly opposed. The end to end distance of the bosses was about 2½".

The finished casting showed surfaces of excellent quality. Sections were cut for further examination. Internal voids in boss sections were minimal or non-existent. The cell structure quality was deemed well suited for bipolar electrode service.

EXAMPLE 2

A cell structure specimen was cast of SA-216 Grade WCB steel. This particular structure represented a corner section for the proposed cell designed. Overall dimensions for the structure were approximately 24"×24" with the central barrier being ½" thick. The base diameter of the frustroconical bosses was 3" and the top diameter was 1½". The end to end distance of the bosses was about 2½", as was the thickness of the periphery.

After casting, the specimen was machined on both anode and cathode sides so as to provide two parallel planes. The anolyte and catholyte peripheral structures were closely examined. No large voids and few small voids were found. The lateral faces of the periphery were suitable for finishing with a minimum amount of machine work necessary to meet gasketing and sealing requirements. Sections cut from the specimen revealed minimal or non-existent voids.

EXAMPLE 3

Cell structures were cast of SA-216, grade WCB steel for a nominal 4 foot by 8 foot electrolyzer press. The purpose of this example was to verify the castability of the particular shape and determine minimum central barrier thickness. The thickness of the central barrier of this structure was approximately 9/16". The base diameter of the frustoconical bosses was 3" and the top diameter was 1½". The end to end distance of the bosses was about 2½", as was the thickness of the periphery. The surfaces of the anode and cathode side were of acceptable quality with only minor surface imperfections present on the cope side of the casting. In repetitive use of the mold, no substantial variation in casting quality was observed. This example demonstrates that a steel casting of this size and shape was feasible for mass production of a cell structure.

EXAMPLE 4

Four (4) electric current transmission elements were cast for a nominal 61 cm (2 feet) by 61 cm (2 feet) monopolar electrolyzer.

All electric current transmission elements were cast of ASTM A536, GRD65-45-12 ductile iron and were identical in regard to as-cast dimensions. Finished castings were inspected and found to be structurally sound and free of any surface defects. Primary dimensions included: nominal 61 cm (24 in.) by 61 cm (24 in.) outside dimensions, a 2 cm (0.80 in.) thick central barrier, 16, 2.5 cm (one in.) diameter bosses located on each side of the central barrier and directly opposing each other, a 2.5 cm (one in.) wide sealing means area 6.4 cm (2.5 in.) thick around the periphery of the cell casting. Machined areas included the sealing means faces (both sides parallel) and the top of each boss (each side machined in a single plane and parallel to the opposite side). There were sixteen bosses on each side.

The cathode cell incorporated 0.9 mm (0.035 in.) thick protective nickel liners on each side of the cell structure. Inlet and outlet nozzles, also constructed of nickel were prewelded to the liners prior to spot welding the liners to the cell structure. Final assembly included spot welding catalytically coated nickel electrodes to the liners at each boss location.

The distance between the planes of the ends of the bosses was 58.2 mm (2.290 in.) for the monopolar cathode cell, which may be called the central cell element thickness. The overall cell thickness, from the outside of one nickel electrode component to the outside of the other nickel electrode component was 69.2 mm (2.726 in.). Thus, the cell element thickness was 92% of the total thickness.

The cathode terminal cell was similar to the cathode cell with the exception that a protective nickel liner was not required on one side, as well as the lack of an accompanying nickel electrode.

The anode cell incorporated 0.9 mm (0.035 in.) thick protective titanium liners on each side of the cell structure. Inlet and outlet nozzles, are constructed of titanium, were prewelded to the liners prior to spot welding the liners to the cell structure. Final assembly included spot welding titanium electrodes to the liners at each boss location through intermediate vanadium metal and titanium disc. The anodes were coated with a catalytic layer of mixed oxides of ruthenium and titanium.

The anode terminal cell was similar to the anode cell with the exception that a protective titanium liner was not required on one side, as well as the lack of an accompanying titanium electrode.

We claim:

1. A method for making an integrally formed, one-piece central cell element which is useful as a major part of one of the repeating cell structural units disposed between the two terminal cells of a filter press series of electrochemical cells, said method comprising:

forming a central cell element from an electrically conductive metal in a mold by melting said metal, pouring said melted metal into said mold, and allowing said metal to cool and harden in said mold, with said mold having its interior shaped so that the central cell element has: (A) a central barrier, (B) a peripheral flange around the periphery of the central cell element which forms the peripheral boundaries of electrode compartments located on both sides of the central barrier, and (c) bosses projecting outwardly from both sides of the central barrier.

2. The method of claim 1 wherein the integrally formed, central cell element is protected from an electrolyte to which it might be exposed by the steps comprised of:

forming a pan for at least one side of the two sides of the central cell element from at least one sheet of metal which is impervious to and chemically nonreactive with the electrolyte to which it is to be exposed, said pan being formed so as to cover said cell element side and to conform substantially to the shape of said central cell element side, including having caps pressed into the pan in a manner such that the pan can be electrically and mechanically attached to the bosses on that side of the central cell element by welding, and welding at least half of said caps of each pan to said bosses.

3. The method of claim 2 wherein the metal used to make the central cell element is a ferrous metal, and where the metal of which the pan is made is titanium, and where the welding of the titanium caps to the central cell bosses is done through a metal intermediate placed between the bosses and the pan's caps where the welds are made with said metal intermediate being a metal which is weldably compatible with both the ferrous metal and titanium metal.

4. The method of claim 2 wherein the metal used to make the central cell element is a ferrous metal, and wherein the metal used to make the pan is nickel.

5. The method of claim 2 wherein the central cell element is made of a ferrous metal and wherein a pan is formed of both sides of said central cell element.

6. The method of claim 5 wherein both pans are made of titanium.

7. The method of claim 5 wherein both pans are made of nickel.

8. The method of claim 5 wherein one pan is made of titanium and the other pan is made of nickel.

9. The method of claim 1 wherein the metal used to make the central cell element is ferrous metal.

10. The method of claim 1 wherein the metal is formed into the central cell element by melting the metal, flowing it into a mold, allowing it to cool until it is capable of sufficiently retaining its shape upon its removal from the mold, and then removing it from the mold.

11. The method of claim 1, 2, 9, 10, 3, 4, 5, 6, 7 or 8 which further comprises the step of assembling at least one of the cell units made by said method into a filter press type cell series.

12. The method of claim 11 which further comprises attaching electrical leads to the cell units of the cell series in a manner so as to make the cell series a monopolar cell series.

13. The method of claim 11 which further comprises attaching electrical leads to the cell units of the cell series in a manner so as to make the cell series a bipolar cell series.

14. A method of making and assembling a cell unit capable of being disposed between the two terminal cells of a filter press electrolysis cell series, said method comprising:

(A) forming an integral solid casting of a central cell element for said cell unit from an electrically conductive metal in a mold by melting said metal, pouring said melted metal into said mold, and allowing said metal to cool and harden in said mold, said mold having its interior shaped so that the central cell element has: (1) a central barrier, (2) a peripheral flange around the periphery of the casting to form the outside boundaries of the electrode compartments which are located on both sides of the central barrier, and (3) solid bosses projecting outwardly from both sides of the central barrier;

(B) removing said central cell element from said mold; and (C) welding a substantially planarly disposed electrode element to the ends of the bosses.

15. The method of claim 14 wherein the metal used to form the central cell element is a ferrous metal.

16. The method of claim 14 wherein the metal is formed into the central cell element by melting the metal, flowing it into a mold, allowing it to cool until it is capable of sufficiently retaining its shape upon its removal from the mold, and then removing it from the mold.

17. The method of claim 14 wherein a pan is attached to at least one side of said central cell element between the central cell element and the attached electrode thereby leaving the electrode attached to the pan instead of the central cell element, said pan having previously been formed from at least one sheet of metal which is impervious to and chemically non-reactive with the electrolyte to which it is to be exposed, said pan being formed so as to cover said sides of said central cell element to which it is attached, said pan being shaped so as to conform substantially to the shape of said side of the central cell element including having hollow caps pressed into the pan in a manner such that these hollow caps fit over and around the bosses, said attachment of said pans to said central cell element's sides being accomplished by welding at least half of each pan's hollow caps to the bosses located on each side of said central cell element.

18. The method of claim 14 wherein the central cell element is made of a ferrous metal and wherein a pan is formed for both sides of said central cell element.

19. The method of claim 14 wherein both pans are made of titanium.

20. The method of claim 14 wherein both pans are made of nickel.

21. The method of claim 14 wherein one pan is made of titanium and the other pan is made of nickel.

22. The method of claim 14, 15, 16, 17, 18, 19, 20 or 21 which further comprises the step of assembling at least one of the cell units made by said method into a filter press type cell series.

23. The method of claim 22 which further comprises attaching electrical leads to the cell units of the cell series in a manner so as to make the cell series a monopolar cell series.

24. The method of claim 22 which further comprises attaching electrical leads to the cell units of the cell series in a manner so as to make the cell series a bipolar cell series.

25. A method of making and assembling a cell unit capable of being disposed between the two terminal cells of a filter press electrolysis cell series, said method comprising:

(A) forming a central cell element for said cell unit from an electrically conductive metal in a mold by melting said metal, pouring said melted metal into said mold, and allowing said metal to cool and harden in said mold, said mold having its interior shaped so that the central cell element has: (1) a central barrier, (2) a peripheral flange around the peripheral of the casting to form the outside boundaries of the electrode compartments which are located on both sides of the central barrier, and (3) bosses projecting outwardly from both sides of the central barrier;

(B) removing said central cell element from said mold;

(C) attaching a pan to each side of said central cell element, said pan having previously been formed from at least one sheet of metal which is impervious to and chemically non-reactive with the electrolyte to which it is to be exposed, said pan being formed so as to cover said side of said central cell element to which it is attached, said pan being shaped so as to conform substantially to the shape of said side of the central cell element including having hollow caps pressed into the pan in a manner such that these hollow caps fit over and around the bosses, said attachment of said pans to said central cell element's sides being accomplished by welding at least half of each pan's hollow caps to the bosses located on each side of said central cell element; and (D) welding at least one substantially planarly disposed electrode element to the ends of the caps of each of the two pans.

26. The method of claim 25 wherein the central cell element is made of a ferrous metal and at least one of the two impervious pans is made of titanium.

27. The method of claim 25 wherein the central cell element is made of ferrous metal and at least one of the two impervious pans is made of nickel.

28. The method of claim 25, 26 or 27 which further comprises the step of assembling at least one of the cell units made by said method into a filter press type cell series.

29. The method of claim 28 which further comprises attaching electrical leads to the cell units of the cell series in a manner so as to make the cell series a monopolar cell series.

30. The method of claim 28 which further comprises attaching electrical leads to the cell units of the cell series in a manner so as to make the cell series a bipolar cell series.

31. A method of making and assembling a cell unit capable of being disposed between the two terminal cells of a filter press electrolysis cell series, said method comprising:

(A) forming an integral solid casting of a central cell element for said cell unit by pouring a molten, electrically conductive, metal into a mold and cooling it therein until it becomes sufficiently rigid to retain the shape imparted to it by the mold upon its removal from the mold, said mold having its interior shaped so that the central cell element has: (1) a central barrier, (2) a peripheral flange around the periphery of the casting to form the outside boundaries of the electrode compartments which are located on both sides of the central barrier, and (3) solid bosses projecting outwardly from both sides of the central barrier;

(B) removing said central cell element from said mold;

(C) attaching a pan to each side of said central cell element, said pan having previously been formed from at least one sheet of metal which is impervious to and chemically non-reactive with the electrolyte to which it is to be exposed, said pans being formed so as to cover said sides of said central cell element, said pan being shaped so as to conform substantially to the shape of the side of the central cell element including having frustums of hollow cones pressed into the pan in a manner such that these hollow cones fit over and around the bosses, said attachment of said pans to said central cell element's sides being accomplished by welding at least half of each pan's hollow conical frustums to the bosses located on each side of said central cell element; and (D) welding a substantially planaraly disposed electrode element to the ends of the conical frustums of the two pans.

32. The method of claim 31 wherein the central cell element is made of a ferrous metal and the impervious pans are made of titanium.

33. The method of claim 31 wherein the central cell element is made of a ferrous metal and the two impervious pans are made of nickel.

34. The method of claim 31 wherein the central cell element is made of a ferrous metal and wherein one of the two impervious pans is made of titanium and the other is made of nickel.

35. The method of claim 31, 32, 33 or 34 which further comprises the step of assembling at least one of the cell units made by said method into a filter press type cell series.

36. The method of claim 31, 32 or 33 which further comprises the step of assembling at least one of the cell units made by said method into a filter press type cell series and attaching electrical leads to the cell units of the cell series in a manner so as to make the cell series a monopolar cell series.

37. The method of claim 31 or 34 which further comprises the steps and assembling at least one of the cell units made by said method into a filter press type cell series and attaching electrical leads to the cell units of the cell series in a manner so as to make the cell series a bipolar cell series.

* * * * *

UNITED STATES PATENT AND TRADEMARK OFFICE

CERTIFICATE OF CORRECTION

PATENT NO. : 4,581,114

DATED : April 8, 1986

INVENTOR(S) : Gregory J.E. Morris, Richard N. Beaver, Sandor Grosshandler, John R. Pimlott and Hiep D. Dang It is certified that error appears in the above-identified patent and that said Letters Patent is hereby corrected as shown below:

Col. 2, line 20; insert --of the -- before "cell".
Col. 11, line 18; reads "The", should read --This--.
Col. 11, line 59; reads "line", should read --lie--.
Col. 14, line 9; reads "come", should read --some--.
Col. 18, line 62; insert --to-- after "as", second occurrence.
Col. 18, line 67; remove "the".
Col. 19, line 51; reads "4,215,333", should read --4,251,333--.
Col. 21, line 8; reads "frustronconically", should read --frustoconically--.
Col. 21, line 10; reads "frustrums", should read --frustums--.
Col. 22, line 20; reads "by", should read --be--.
Col. 23, line 25; remove the comma after "in".
Col. 28, line 29; reads "electrial", should read --electrical--.
Col. 29, line 22; reads "frustoconical", should read --frustroconical--.
Col. 30, line 5; reads "are", should read --also--.
Col. 30, line 32; reads "(c)", should read --(C)--.
Col. 30, line 66; reads "of", should read --for--.
Col. 32, line 35; reads "peripheral", should read --periphery--.
Col. 34, line 8; reads "planaraly", should read --planarly--.

Signed and Sealed this

Thirtieth Day of December, 1986

*Attest:*

DONALD J. QUIGG

*Attesting Officer*

*Commissioner of Patents and Trademarks*